US007694398B2

(12) United States Patent
Enomoto et al.

(10) Patent No.: US 7,694,398 B2
(45) Date of Patent: Apr. 13, 2010

(54) METHOD OF MANUFACTURING A LIQUID EJECTION HEAD

(75) Inventors: Katsumi Enomoto, Kanagawa (JP); Yasuhiko Maeda, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 679 days.

(21) Appl. No.: 11/520,585

(22) Filed: Sep. 14, 2006

(65) Prior Publication Data

US 2007/0058004 A1 Mar. 15, 2007

(30) Foreign Application Priority Data

Sep. 15, 2005 (JP) ..... 2005-268561

(51) Int. Cl.
*H04R 17/00* (2006.01)
*B05D 1/32* (2006.01)

(52) U.S. Cl. ..... 29/25.35; 29/890.1; 29/846; 427/97.7; 427/282; 347/70

(58) Field of Classification Search ..... 29/25.35, 29/890.1, 846, 831; 427/97.7, 282, 123; 347/70, 71
See application file for complete search history.

(56) References Cited

U.S. PATENT DOCUMENTS 3,347,724 A * 10/1967 Schneble, Jr. et al. ... 427/282 X
5,752,303 A * 5/1998 Thiel ..... 29/25.35

FOREIGN PATENT DOCUMENTS

JP 61224713 A * 10/1986 ..... 29/25.35 X
JP 6-286126 A 10/1994
JP 2002-46281 A 2/2002

* cited by examiner

*Primary Examiner*—A. Dexter Tugbang
(74) *Attorney, Agent, or Firm*—Birch, Stewart, Kolasch & Birch, LLP

(57) ABSTRACT

The method manufactures a liquid ejection head comprising a pressure chamber which accommodates liquid, a diaphragm which forms a portion of the pressure chamber, a piezoelectric element which is disposed on the diaphragm and deforms the pressure chamber through the diaphragm to pressurize the liquid in the pressure chamber so as to eject the liquid from an ejection port in connection with the pressure chamber. The method comprises: a resist layer forming step of applying a resist in a liquid state onto the diaphragm on which the piezoelectric element has been disposed so as to cover the piezoelectric element, and curing the resist to form a resist layer on the diaphragm; a space forming step of separately removing the resist covering a movable portion of the piezoelectric element and the resist covering an electrical connection portion of the piezoelectric element, by exposing and developing the resist formed on the diaphragm, to separately form a movement space and a connection space for the piezoelectric element, in the resist layer; and a conductive material filling step of filling a conductive material into the connection space formed in the resist layer.

4 Claims, 21 Drawing Sheets

METHOD OF MANUFACTURING A LIQUID EJECTION HEAD

BACKGROUND OF THE INVENTION

1. Field of the Invention

The present invention relates to a liquid ejection head and a method of manufacturing a liquid ejection head, and more particularly, to a liquid ejection head and a method of manufacturing a liquid ejection head in which pressure chambers are deformed by means of piezoelectric elements disposed on a diaphragm, and liquid is ejected from ejection ports connected to the pressure chambers.

2. Description of the Related Art

An inkjet recording apparatus is known as one apparatus for recording text characters and images onto a recording medium, such as paper. An inkjet recording apparatus forms images by means of ink dots, by causing ink to be ejected from a recording head comprising nozzles for ejecting ink, in accordance with an image signal, thereby depositing ink droplets onto a print medium, while moving the recording medium relatively with respect to the print head. Typical ink ejection methods are known in which ink is ejected from a nozzle by a bubble generated inside a pressure chamber, or ink is ejected from a nozzle by means of a volume change in a pressure chamber.

In a method which ejects ink from a nozzle by means of a volume change in a pressure chamber, the volume of the pressure chamber is generally changed by using a piezoelectric element. In this case, the piezoelectric element is disposed on a diaphragm which constitutes one portion of the pressure chamber, and a drive voltage is applied to the piezoelectric element through a flexible printed circuit (FPC). However, if the flexible printed circuit and the piezoelectric element are disposed in contact with each other, then there is a problem in that the deformation of the piezoelectric element is restricted. Furthermore, if ink reaches the piezoelectric element, then there is a risk of the piezoelectric element being shorted by this ink.

Japanese Patent Application Publication No. 6-286126 discloses that an adhesive layer is formed so as to surround the peripheries of piezoelectric elements, and the piezoelectric elements are sealed hermetically inside spaces by bonding a flexible printed circuit by means of this adhesive layer, and furthermore, projections are formed so as to surround the peripheries of piezoelectric elements and the piezoelectric elements are sealed hermetically inside spaces by fixing a flexible printed circuit to the projections, by means of an adhesive.

Japanese Patent Application Publication No. 2002-46281 discloses that a bonding substrate formed integrally with an integrated circuit is bonded through a sealing member onto a flow channel substrate on which piezoelectric elements are provided, and by connecting the piezoelectric elements with the integrated circuit through lead electrodes, the piezoelectric elements are hermetically sealed inside the spaces demarcated by the bonding substrate and the sealing member.

However, in Japanese Patent Application Publication No. 6-286126, since the flexible printed circuit is actually supported by the adhesive layer, the thickness of the adhesive layer is reduced by the bonding pressure, and the flexible printed circuit makes contact with the piezoelectric elements, thereby restricting the piezoelectric elements and thus preventing stable ejection. Furthermore, since the movable portion and the electrical connection portion of the piezoelectric element are not demarcated, then it is necessary to provide a conductive material locally on the electrode of the piezoelectric element, thus giving rise to problems of increased manufacturing work and the occurrence of variations.

Moreover, in Japanese Patent Application Publication No. 2002-46281, the flow channel substrate and the bonding substrate must be made of monocrystalline silicon, and hence there is no freedom in the choice of material. Furthermore, if the sealing member is made of adhesive only, then in order to seal off the piezoelectric elements individually, the adhesive must be applied in a very fine pattern, and therefore, the process becomes highly complex. On the other hand, if the sealing member is made of a hard material, such as glass or silicon, then it is not possible to demarcate completely the movable portion and the electrical connection portion of the piezoelectric element, and therefore a conductive material must be provided locally on the electrical connection portion of the piezoelectric element, thus giving rise to problems of increased manufacturing work and the occurrence of variations.

SUMMARY OF THE INVENTION

The present invention has been contrived in view of the foregoing circumstances, an object thereof being to provide a liquid ejection head and a method of manufacturing same, whereby the manufacturing process can be simplified, and connection reliability can be ensured.

In order to attain the aforementioned object, the present invention is directed to a method of manufacturing a liquid ejection head comprising a pressure chamber which accommodates liquid, a diaphragm which forms a portion of the pressure chamber, a piezoelectric element which is disposed on the diaphragm and deforms the pressure chamber through the diaphragm to pressurize the liquid in the pressure chamber so as to eject the liquid from an ejection port in connection with the pressure chamber, the method comprising: a resist layer forming step of applying a resist in a liquid state onto the diaphragm on which the piezoelectric element has been disposed so as to cover the piezoelectric element, and curing the resist to form a resist layer on the diaphragm; a space forming step of separately removing the resist covering a movable portion of the piezoelectric element and the resist covering an electrical connection portion of the piezoelectric element, by exposing and developing the resist formed on the diaphragm, to separately form a movement space and a connection space for the piezoelectric element, in the resist layer; and a conductive material filling step of filling a conductive material into the connection space formed in the resist layer.

According to this aspect of the present invention, the peripheral regions of the piezoelectric elements on the diaphragm are sealed in a state where they are filled with a liquid resist. In this case, the liquid resist is additionally applied so as to cover the piezoelectric elements, and the resist is then cured to form a further resist layer. The resist covering the movable portions and the electrical connection portions of the piezoelectric elements is then separately removed, by exposing and developing the resist formed on the diaphragm, to form separate movement spaces and connection spaces, in the resist layer. Thereupon, the conductive material is filled into the connection spaces, thereby forming connection portions with the piezoelectric elements. Thereby, the peripheral regions of the piezoelectric elements are sealed in a state where they are filled with the resist. By sealing the periphery of the piezoelectric elements with the resist in this way, it is possible to effectively prevent leak currents, as well as guaranteeing the reliability of the electrical connections. In this case, since the resist is a soft material, it has very little adverse effect on the displacement of the piezoelectric element, and therefore stable operation can be achieved. Furthermore, since the movable portion and the electrical connection portion of each piezoelectric element are completely separated from each other by means of the movement space and the connection space formed in the resist layer, it is easy to form the connection portions for the piezoelectric elements, without the conductive material projecting into the movable portion, and therefore the manufacturing process can be simplified.

Preferably, the method further comprises: a substrate bonding step of bonding, onto the resist layer, a substrate having a through hole at a position corresponding to the connection portion of the piezoelectric element, after the space forming step, wherein, in the conductive material filling step, the conductive material is filled into the through hole in the substrate and the connection space in the resist layer.

According to this aspect of the present invention, it is possible to seal the piezoelectric elements completely, thereby preventing deterioration of the piezoelectric elements due to condensation, or leaking ink. Moreover, since the wiring layer and the piezoelectric elements can be arranged in separate layers, then the available space is increased, and hence the number of nozzles and the density of the nozzles can be increased.

Preferably, the conductive material is one of a conductive adhesive, a conductive paste and a conductive ink; and in the conductive material filling step, the conductive material is filled into the through hole and/or the connection space by one of screen printing and vacuum printing.

According to this aspect of the present invention, a large number of connections can be made reliably, without exerting pressure on the piezoelectric elements.

In order to attain the aforementioned object, the present invention is also directed to a liquid ejection head, comprising: a pressure chamber which accommodates liquid; a diaphragm which forms a portion of the pressure chamber; a piezoelectric element which is disposed on the diaphragm and deforms the pressure chamber through the diaphragm to pressurize the liquid in the pressure chamber so as to eject the liquid from an ejection port in connection with the pressure chamber; a resist layer which is formed by applying a resist in a liquid state onto the diaphragm on which the piezoelectric element has been disposed so as to cover the piezoelectric element, and curing the resist, the resist layer having a movement space formed by removing the resist over a movable portion of the piezoelectric element by exposing and developing the resist, the resist layer having a connection space formed separately from the movement space, by removing the resist over an electrical connection portion of the piezoelectric element by exposing and developing the resist; and a conductive material which fills the connection space.

According to this aspect of the present invention, the peripheral regions of the piezoelectric elements are sealed in a state where they are filled with the resist. Thereby, it is possible to effectively prevent leakage currents, as well as ensuring reliability in the driving of the piezoelectric elements. In this case, since the resist is a soft material, it has very little adverse effect on the displacement of the piezoelectric elements, and therefore stable operation can be achieved. Furthermore, since the movable portion and the electrical connection portion of each piezoelectric element are completely separated from each other by means of the movement space and the connection space formed in the resist layer, it is easy to form connection portions for the piezoelectric elements, and therefore the manufacturing process can be simplified.

Preferably, the liquid ejection head further comprises: a substrate which is bonded on the resist layer and has a through hole in connection with the connection space, wherein the conductive material fills the through hole and the connection space.

According to this aspect of the present invention, it is possible to seal the piezoelectric elements completely, thereby preventing deterioration of the piezoelectric elements due to condensation, or leaking ink.

According to the liquid ejection head and the method of manufacturing the liquid ejection head according to the present invention, it is possible to simplify the manufacturing process, as well as guaranteeing the reliability of electrical connections.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

Figure 1:
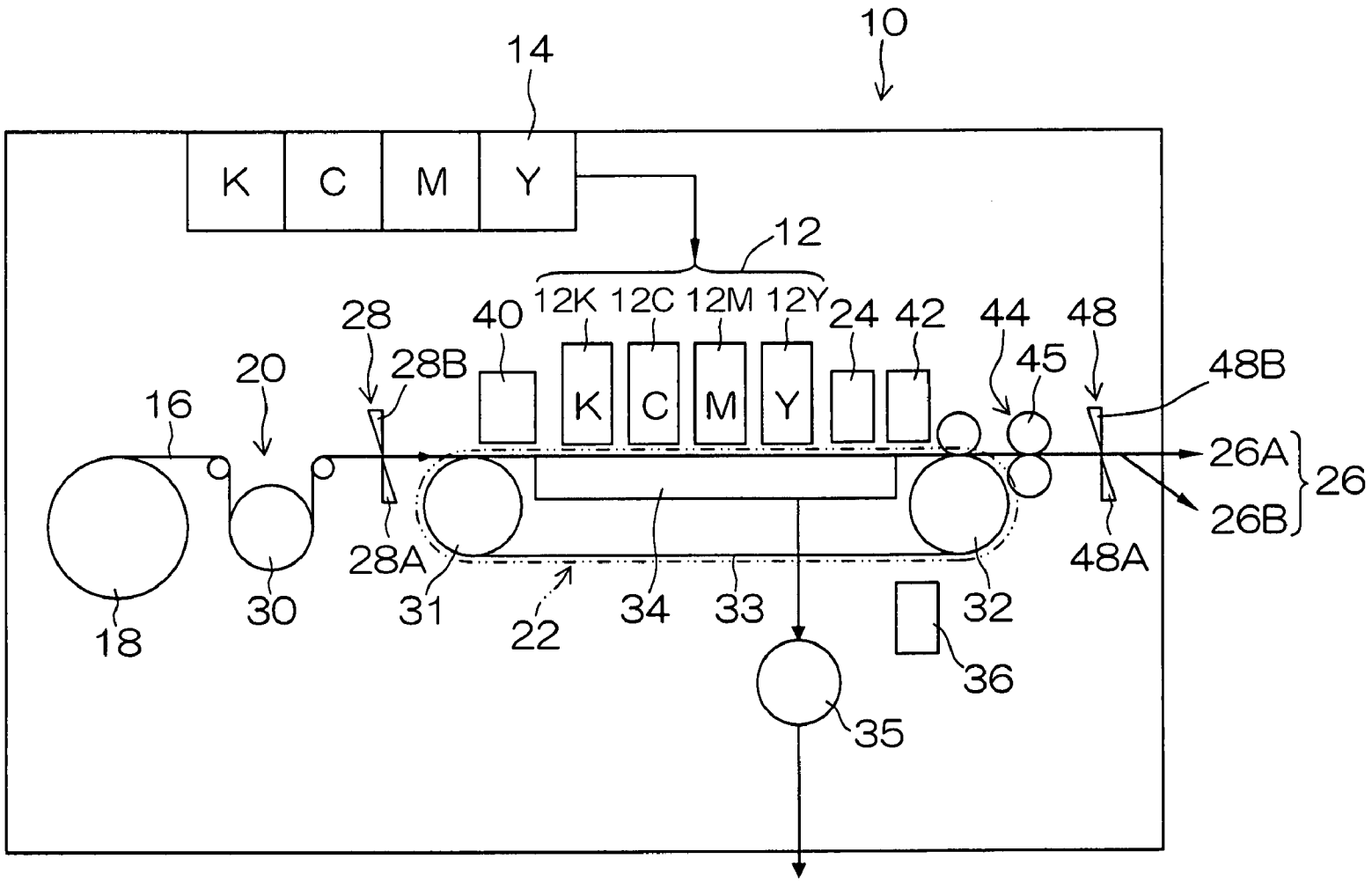
FIG. 1 is a general schematic drawing showing a general view of an inkjet recording apparatus having a liquid ejection head according to an embodiment of the present invention.

FIG. 1 is a general schematic drawing showing an approximate view of an inkjet recording apparatus having a liquid ejection head according to an embodiment of the present invention.

As shown in FIG. 1, the inkjet recording apparatus 10 comprises: a print unit 12 having a plurality of print heads (liquid ejection head) 12K, 12C, 12M, and 12Y for ink colors of black (K), cyan (C), magenta (M), and yellow (Y), respectively; an ink storing and loading unit 14 for storing inks of K, C, M and Y to be supplied to the print heads 12K, 12C, 12M, and 12Y; a paper supply unit 18 for supplying recording paper 16; a decurling unit 20 for removing curl in the recording paper 16; a suction belt conveyance unit 22 disposed facing the nozzle face (ink-droplet ejection face) of the print unit 12, for conveying the recording paper 16 while keeping the recording paper 16 flat; a print determination unit 24 for reading the printed result produced by the print unit 12; and a paper output unit 26 for outputting image-printed recording paper (printed matter) to the exterior.

In FIG. 1, a magazine for rolled paper (continuous paper) is shown as an embodiment of the paper supply unit 18; however, more magazines with paper differences such as paper width and quality may be jointly provided. Moreover, papers may be supplied with cassettes that contain cut papers loaded in layers and that are used jointly or in lieu of the magazine for rolled paper.

In the case of a configuration in which roll paper is used, a cutter 28 is provided as shown in FIG. 1, and the roll paper is cut to a desired size by the cutter 28. The cutter 28 has a stationary blade 28A, whose length is not less than the width of the conveyor pathway of the recording paper 16, and a round blade 28B, which moves along the stationary blade 28A. The stationary blade 28A is disposed on the reverse side of the printed surface of the recording paper 16, and the round blade 28B is disposed on the side adjacent to the printed surface across the conveyance path. When cut paper is used, the cutter 28 is not required.

In the case of a configuration in which a plurality of types of recording paper can be used, it is preferable that an information recording medium such as a bar code and a wireless tag containing information about the type of paper is attached to the magazine, and by reading the information contained in the information recording medium with a predetermined reading device, the type of paper to be used is automatically determined, and ink-droplet ejection is controlled so that the ink-droplets are ejected in an appropriate manner in accordance with the type of paper.

The recording paper 16 delivered from the paper supply unit 18 retains curl due to having been loaded in the magazine. In order to remove the curl, heat is applied to the recording paper 16 in the decurling unit 20 by a heating drum 30 in the direction opposite to the curl direction in the magazine. In this, the heating temperature is preferably controlled in such a manner that the medium has a curl in which the surface on which the print is to be made is slightly rounded in the outward direction.

The decurled and cut recording paper 16 is delivered to the suction belt conveyance unit 22. The suction belt conveyance unit 22 has a configuration in which an endless belt 33 is set around rollers 31 and 32 so that the portion of the endless belt 33 facing at least the nozzle face of the print unit 12 and the sensor face of the print determination unit 24 forms a plane (flat plane).

The belt 33 has a width that is greater than the width of the recording paper 16, and a plurality of suction apertures (not shown) are formed on the belt surface. A suction chamber 34 is disposed in a position facing the sensor surface of the print determination unit 24 and the nozzle surface of the print unit 12 on the interior side of the belt 33, which is set around the rollers 31 and roller 32, as shown in FIG. 1. The suction chamber 34 provides suction with a fan 35 to generate a negative pressure, and the recording paper 16 on the belt 33 is held by suction.

The belt 33 is driven in the clockwise direction in FIG. 1 by the motive force of a motor (not shown) being transmitted to at least one of the rollers 31 and 32, which the belt 33 is set around, and the recording paper 16 held on the belt 33 is conveyed from left to right in FIG. 1.

Since ink adheres to the belt 33 when a marginless print job or the like is performed, a belt-cleaning unit 36 for cleaning the belt 33 is disposed in a predetermined position (a suitable position outside the printing area) on the exterior side of the belt 33. Although the details of the configuration of the belt-cleaning unit 36 are not shown, embodiments thereof include a configuration in which the belt 33 is nipped with cleaning rollers such as a brush roller and a water absorbent roller, an air blow configuration in which clean air is blown onto the belt 33, or a combination of these. In the case of the configuration in which the belt 33 is nipped with the cleaning rollers, it is preferable to make the line velocity of the cleaning rollers different than that of the belt 33 to improve the cleaning effect.

The inkjet recording apparatus 10 can comprise a roller nip conveyance mechanism, instead of the suction belt conveyance unit 22. However, there is a drawback in the roller nip conveyance mechanism that the print tends to be smeared when the printing area is conveyed by the roller nip action because the nip roller makes contact with the printed surface of the paper immediately after printing. Therefore, the suction belt conveyance in which nothing comes into contact with the image surface in the printing area is preferable.

A heating fan 40 is disposed on the upstream side of the print unit 12 in the conveyance pathway formed by the suction belt conveyance unit 22. The heating fan 40 blows heated air onto the recording paper 16 to heat the recording paper 16 immediately before printing so that the ink deposited on the recording paper 16 dries more easily.

Figure 2:
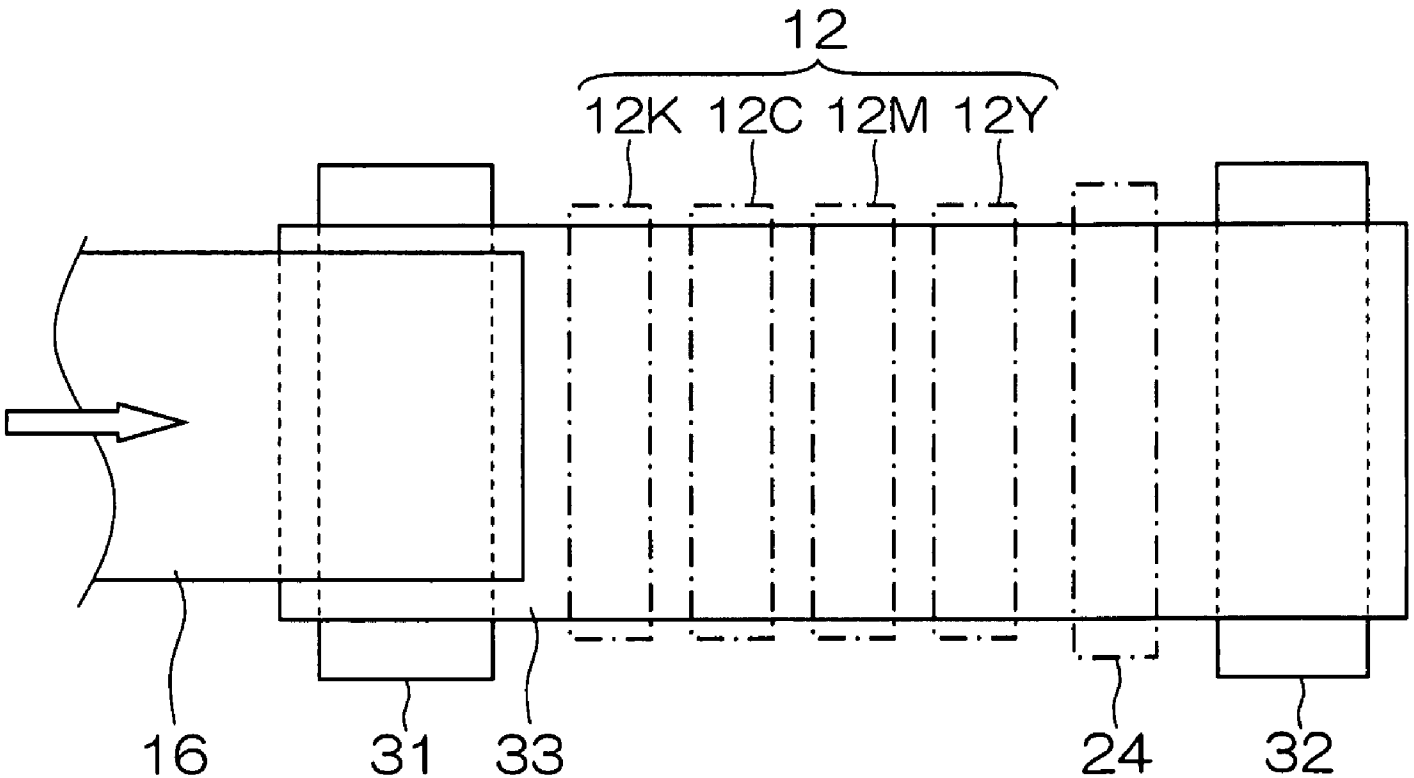
FIG. 2 is a plan diagram showing the principal composition of the peripheral area of a print unit of the inkjet recording apparatus.

The print unit 12 is a so-called "full line head" in which a line head having a length corresponding to the maximum paper width is arranged in the direction (main scanning direction) that is perpendicular to the paper conveyance direction (sub-scanning direction) (see FIG. 2).

As shown in FIG. 2, the print heads 12K, 12C, 12M and 12Y are constituted by line heads in which a plurality of nozzles (ink ejection ports) are arranged through a length exceeding at least one edge of the maximum size recording paper 16 intended for use with the inkjet recording apparatus 10.

The print heads 12K, 12C, 12M, and 12Y are arranged in the order of black (K), cyan (C), magenta (M), and yellow (Y) from the upstream side (the left side in FIG. 1), along the feed direction of the recording paper 16 (paper conveyance direction). A color image can be formed on the recording paper 16 by ejecting the inks from the print heads 12K, 12C, 12M, and 12Y, respectively, onto the recording paper 16 while conveying the recording paper 16.

The print unit 12, in which the full-line heads covering the entire width of the paper are thus provided for the respective ink colors, can record an image over the entire surface of the recording paper 16 by performing the action of moving the recording paper 16 and the print unit 12 relative to each other in the paper conveyance direction (sub-scanning direction) just once (in other words, by means of a single sub-scan). Higher-speed printing is thereby made possible and productivity can be improved in comparison with a shuttle type head configuration in which a print head moves reciprocally in the direction (main scanning direction) that is perpendicular to the paper conveyance direction.

Here, the terms main scanning direction and sub-scanning direction are used in the following senses. More specifically, in a full-line head comprising rows of nozzles that have a length corresponding to the entire width of the recording paper, "main scanning" is defined as printing one line (a line formed of a row of dots, or a line formed of a plurality of rows of dots) in the breadthways direction of the recording paper (the direction perpendicular to the conveyance direction of the recording paper) by driving the nozzles in one of the following ways: (1) simultaneously driving all the nozzles; (2) sequentially driving the nozzles from one side toward the other; and (3) dividing the nozzles into blocks and sequentially driving the blocks of the nozzles from one side toward the other. The direction indicated by one line recorded by a main scanning action (the lengthwise direction of the band-shaped region) is called the "main scanning direction".

On the other hand, "sub-scanning" is defined as to repeatedly perform printing of one line (a line formed of a row of dots, or a line formed of a plurality of rows of dots) formed by the main scanning action, while moving the full-line head and the recording paper relatively to each other. The direction in which sub-scanning is performed is called the sub-scanning direction. Consequently, the conveyance direction of the recording paper is the sub-scanning direction and the direction perpendicular to same is called the main scanning direction.

Although a configuration with the KMCY four standard colors is described in the present embodiment, the combinations of the ink colors and the number of colors are not limited to these, and light and/or dark inks can be added as required. For example, a configuration is possible in which print heads for ejecting light-colored inks such as light cyan and light magenta are added.

As shown in FIG. 1, the ink storing and loading unit 14 has ink tanks for storing the inks of the colors corresponding to the respective print heads 12K, 12C, 12M, and 12Y, and the respective tanks are connected to the print heads 12K, 12C, 12M, and 12Y by means of channels (not shown). The ink storing and loading unit 14 has a warning device (for example, a display device, an alarm sound generator or the like) for warning when the remaining amount of any ink is low, and has a mechanism for preventing loading errors among the colors.

The print determination unit 24 has an image sensor (line sensor) for capturing an image of the ink-droplet deposition result of the print unit 12, and functions as a device to check for ejection defects such as clogs of the nozzles in the print unit 12 from the ink-droplet deposition results evaluated by the image sensor.

The print determination unit 24 of the present embodiment is configured with at least a line sensor having rows of photoelectric transducing elements with a width that is greater than the ink-droplet ejection width (image recording width) of the print heads 12K, 12C, 12M, and 12Y. This line sensor has a color separation line CCD sensor including a red (R) sensor row composed of photoelectric transducing elements (pixels) arranged in a line provided with an R filter, a green (G) sensor row with a G filter, and a blue (B) sensor row with a B filter. Instead of a line sensor, it is possible to use an area sensor composed of photoelectric transducing elements which are arranged two-dimensionally.

The print determination unit 24 reads a test pattern image printed by the print heads 12K, 12C, 12M, and 12Y for the respective colors, and the ejection of each head is determined. The ejection determination includes the presence of the ejection, measurement of the dot size, and measurement of the dot deposition position.

A post-drying unit 42 is disposed following the print determination unit 24. The post-drying unit 42 is a device to dry the printed image surface, and includes a heating fan, for example. It is preferable to avoid contact with the printed surface until the ink dries after printing, and a device that blows heated air onto the printed surface is preferable.

In cases in which printing is performed using dye-based ink on porous paper, blocking the pores of the paper by the application of pressure can prevent the ink from coming contact with ozone and other substance that cause dye molecules to break down, and can increase the durability of the print.

A heating/pressurizing unit 44 is disposed following the post-drying unit 42. The heating/pressurizing unit 44 is a device to control the glossiness of the image surface, and the image surface is pressed with a pressure roller 45 having a predetermined uneven surface shape while the image surface is heated, and the uneven shape is transferred to the image surface.

The printed matter generated in this manner is outputted from the paper output unit 26. The target print and the test print are preferably outputted separately. In the inkjet recording apparatus 10, a sorting device (not shown) is provided for switching the outputting pathways in order to sort the printed matter with the target print and the printed matter with the test print, and to send them to paper output units 26A and 26B, respectively.

When the target print and the test print are simultaneously formed on the same large sheet of paper, the test print portion is cut and separated by a cutter (second cutter) 48. The cutter 48 is disposed directly in front of the paper output unit 26, and performs a test print in the blank portion of the target print to cut the test print portion from the target print portion. The structure of the cutter 48 is the same as the first cutter 28 described above, and has a stationary blade 48A and a round blade 48B.

Although not shown in the drawings, the paper output unit 26A for the target prints is provided with a sorter for collecting prints according to print orders.

Figure 3:
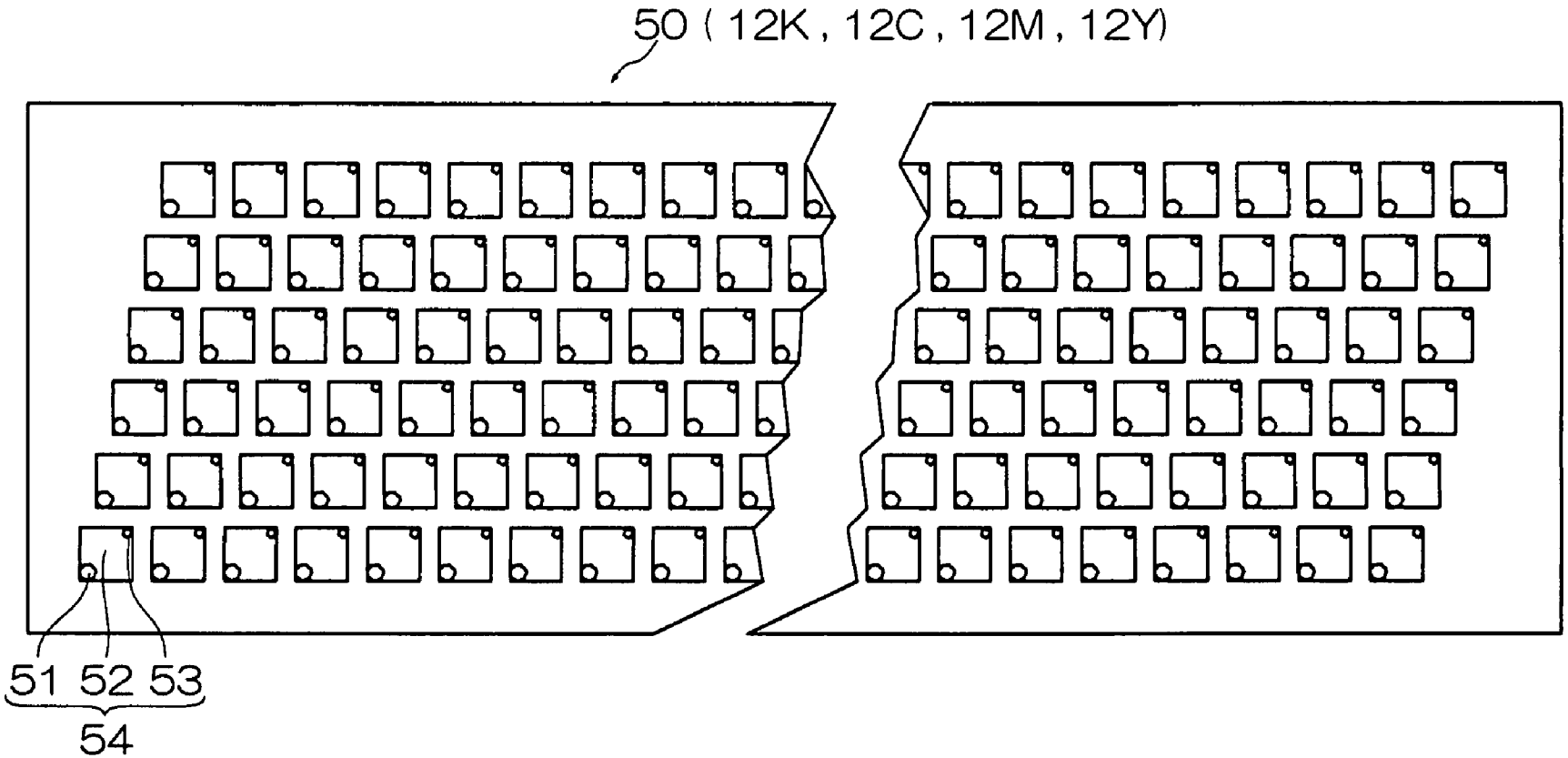
FIG. 3 is a plan view perspective diagram of the print head.

Next, the arrangement of nozzles (liquid ejection ports) in the print head (liquid ejection head) is described. The print heads 12K, 12C, 12M and 12Y each have the same structure, and a print head forming a representative embodiment of these print heads is indicated by the reference numeral 50. FIG. 3 shows a plan view perspective diagram of the print head 50.

As shown in FIG. 3, the print head 50 according to the present embodiment achieves a high density arrangement of nozzles 51 by using a two-dimensional staggered matrix array of pressure chamber units 54, each constituted by a nozzle 51 for ejecting ink as ink droplets, a pressure chamber 52 for ejecting ink from a nozzle 51 by applying pressure to the ink, and an ink supply port 53 for supplying ink to the pressure chamber 52 from a common flow channel (not shown in FIG. 3).

There are no particular limitations on the size of the nozzle arrangement in a print head 50 of this kind, but as one embodiment, 2400 nozzles per inch can be achieved by arranging nozzles 51 in 48 lateral rows (21 mm) and 600 vertical columns (305 mm).

In the embodiment shown in FIG. 3, the planar shape of the pressure chamber 52 is a substantially square shape, but the planar shape of the pressure chamber 52 is not limited to a square shape of this kind.

As shown in FIG. 3, the nozzle 51 is formed at one end of the diagonal of each pressure chamber 52, and the ink supply port 53 is provided at the other end thereof.

Figure 4:
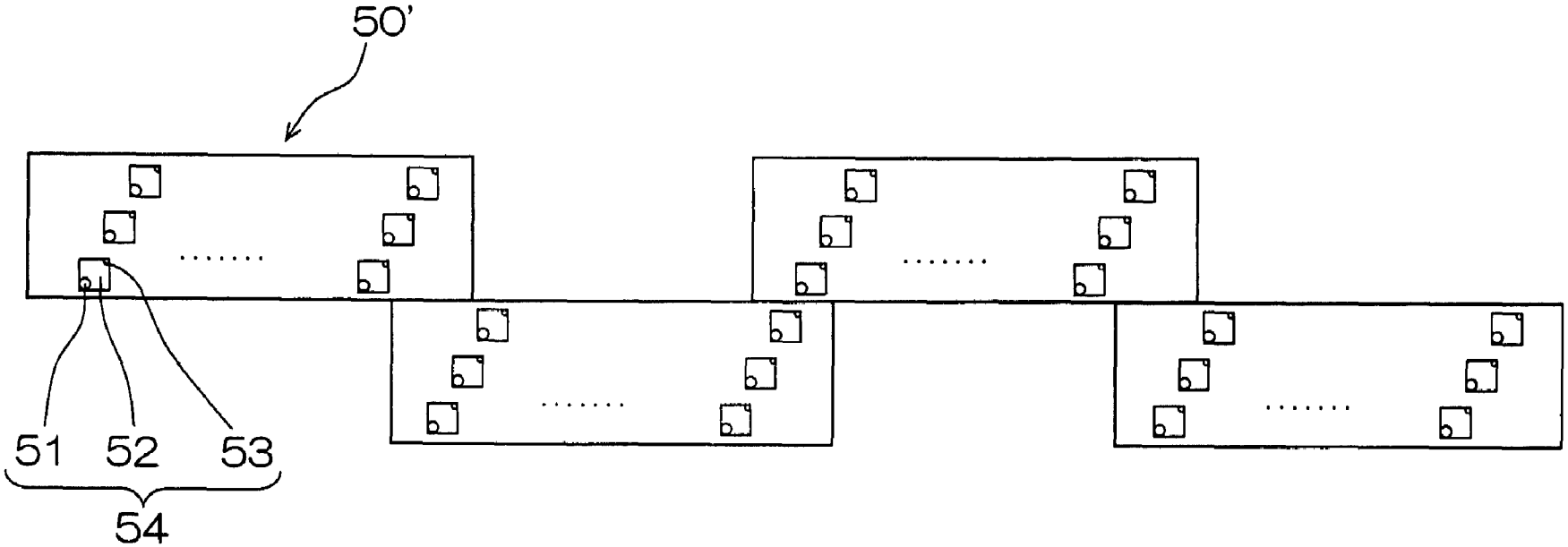
FIG. 4 is a plan view perspective diagram showing a further embodiment of the structure of the print head.

Moreover, FIG. 4 is a plan view perspective diagram showing a further embodiment of the structure of a print head. As shown in FIG. 4, one long full line head may be constituted by combining a plurality of short heads 50' arranged in a two-dimensional staggered array, in such a manner that the combined length of this plurality of short heads 50' corresponds to the full width of the print medium.

Figure 5:
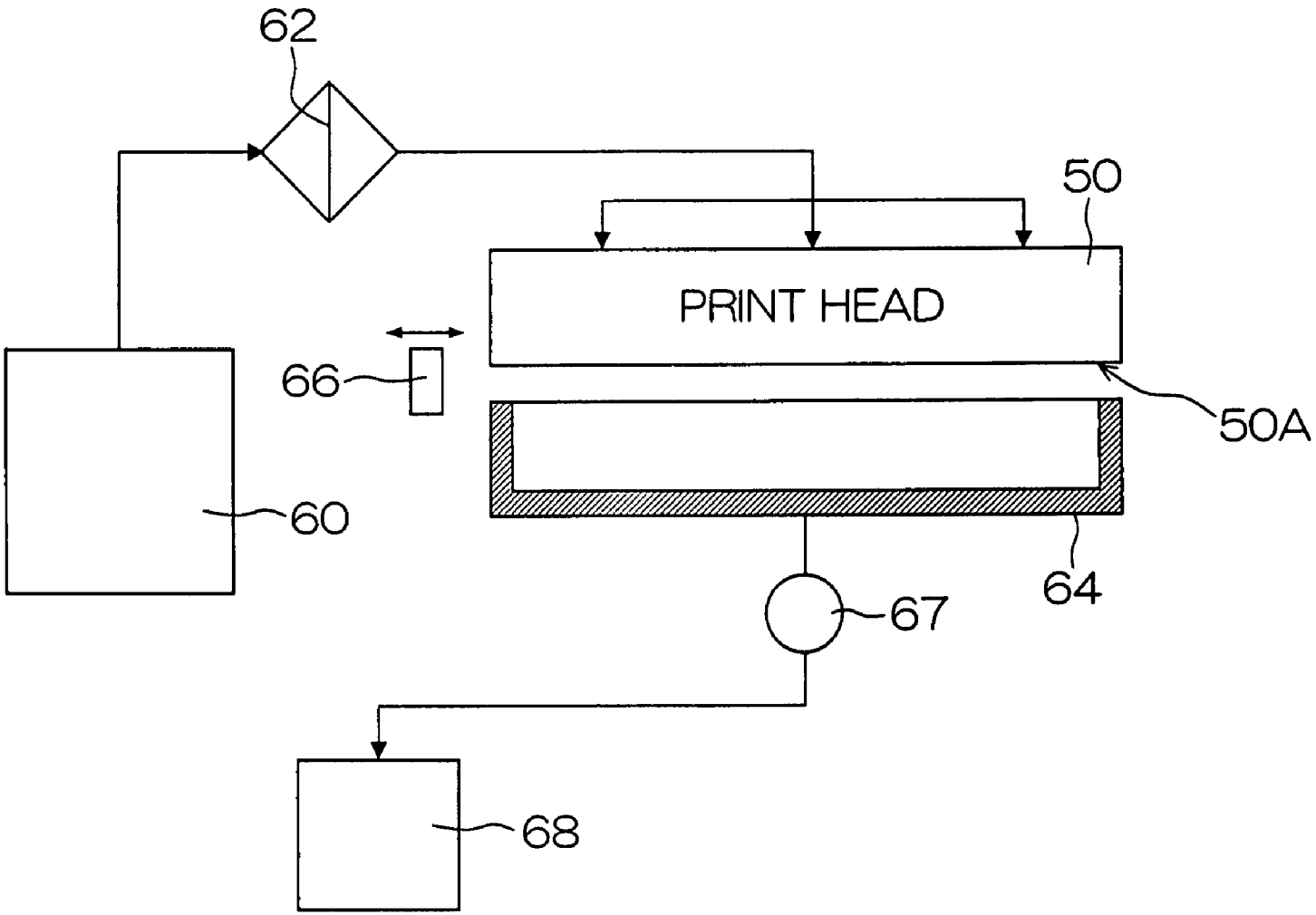
FIG. 5 is a schematic drawing showing the composition of an ink supply system in the inkjet recording apparatus.

FIG. 5 is a schematic drawing showing the configuration of the ink supply system in the inkjet recording apparatus 10.

The ink tank 60 is a base tank that supplies ink to the print head 50 and is set in the ink storing and loading unit 14 described with reference to FIG. 1. The aspects of the ink tank 60 include a refillable type and a cartridge type: when the remaining amount of ink is low, the ink tank 60 of the refillable type is filled with ink through a filling port (not shown) and the ink tank 60 of the cartridge type is replaced with a new one. In order to change the ink type in accordance with the intended application, the cartridge type is suitable, and it is preferable to represent the ink type information with a bar code or the like on the cartridge, and to perform ejection control in accordance with the ink type. The ink tank 60 in FIG. 5 is equivalent to the ink storing and loading unit 14 in FIG. 1 described above.

A filter 62 for removing foreign matters and bubbles is disposed in the middle of the channel connecting the ink tank 60 and the print head 50 as shown in FIG. 5. The filter mesh size in the filter 62 is preferably equivalent to or less than the diameter of the nozzle of the print head 50 and commonly about 20 μm.

Although not shown in FIG. 5, it is preferable to provide a sub-tank integrally to the print head 50 or nearby the print head 50. The sub-tank has a damper function for preventing variation in the internal pressure of the head and a function for improving refilling of the print head.

The inkjet recording apparatus 10 is also provided with a cap 64 as a device to prevent the nozzles from drying out or to prevent an increase in the ink viscosity in the vicinity of the nozzles, and a cleaning blade 66 as a device to clean the nozzle face 50A.

A maintenance unit including the cap 64 and the cleaning blade 66 can be relatively moved with respect to the print head 50 by a movement mechanism (not shown), and is moved from a predetermined holding position to a maintenance position below the print head 50 as required.

The cap 64 is displaced up and down relatively with respect to the print head 50 by an elevator mechanism (not shown). When the power is turned OFF or when in a print standby state, the elevator mechanism raises the cap 64 to a predetermined elevated position to make the cap 64 come into close contact with the print head 50, and the nozzle face 50A is thereby covered with the cap 64.

The cleaning blade 66 is composed of rubber or another elastic member, and is disposed slidably over the ink ejection surface (nozzle surface 50A) of the print head 50 by means of a blade movement mechanism (not shown). If there are ink droplets or foreign matter adhering to the nozzle surface 50A, then the nozzle surface 50A is cleaned by causing the cleaning blade 66 to slide over the nozzle surface 50A, thereby wiping away adhering matter.

During printing or during standby, if the use frequency of a particular nozzle 51 has declined and the ink viscosity in the vicinity of the nozzle 51 has increased, then a preliminary ejection is performed toward the cap 64, in order to remove the ink that has degraded as a result of increasing in viscosity.

Also, when bubbles have become intermixed into the ink inside the print head 50 (the ink inside the pressure chambers 52), the cap 64 is placed on the print head 50, and the ink (ink in which bubbles have become intermixed) inside the pressure chambers 52 is removed by suction with a suction pump 67, and is sent to a recovery tank 68. This suctioning operation is also carried out when new ink is loaded into the head, or when the apparatus starts use after a long period of inactivity, and it makes it possible to remove degraded ink which has increased in viscosity and solidified. In this case, desirably, the inner side of the cap 64 is divided into a plurality of areas by partitioning walls, in such a manner that the area to be suctioned can be selected.

Figure 6:
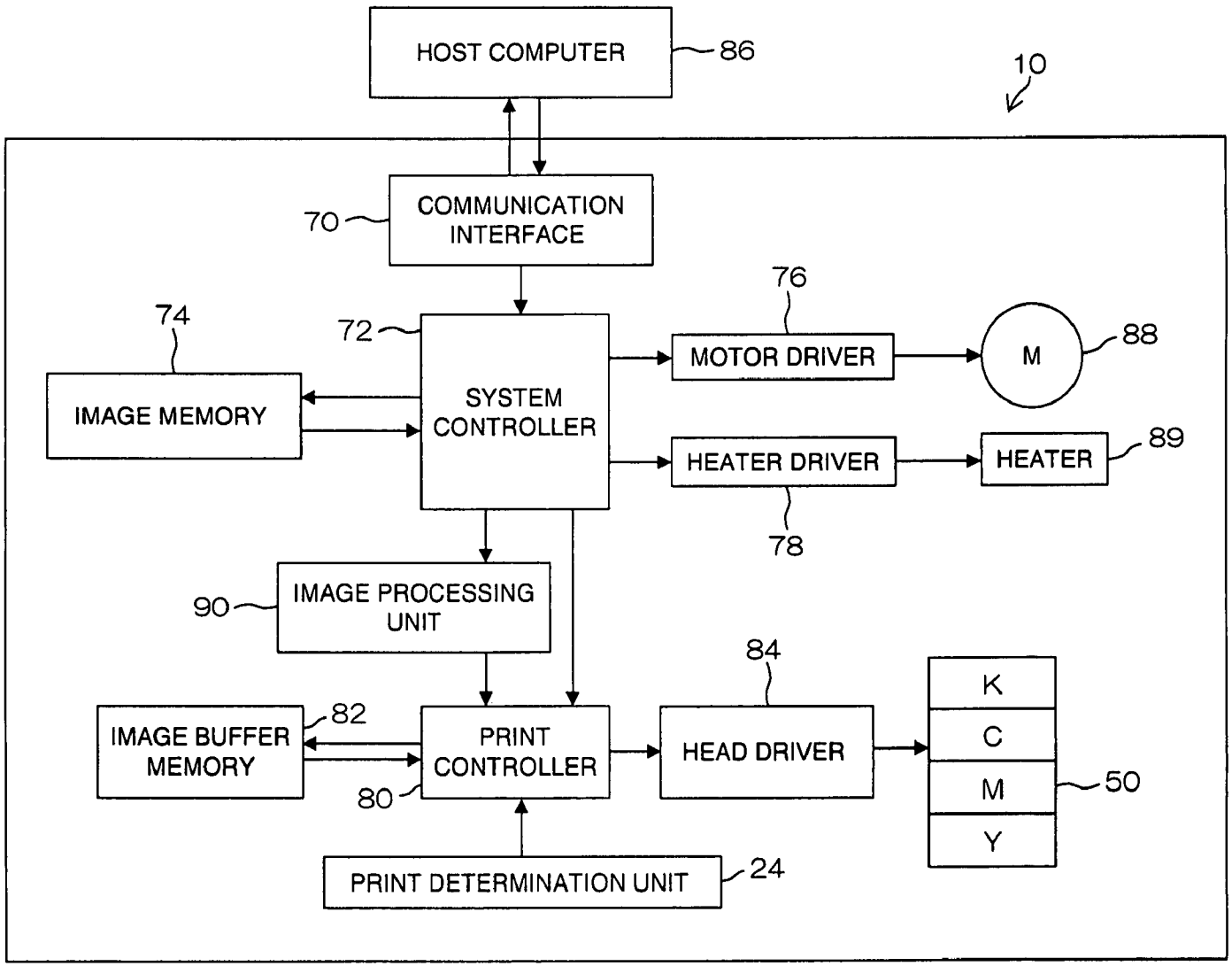
FIG. 6 is a block diagram showing the system composition of the inkjet recording apparatus.

FIG. 6 is a block diagram showing the system configuration of the inkjet recording apparatus 10.

As shown in FIG. 6, the inkjet recording apparatus 10 comprises a communication interface 70, a system controller 72, an image memory 74, a motor driver 76, a heater driver 78, a print controller 80, an image buffer memory 82, a head driver 84, and the like.

The communication interface 70 is an interface unit for receiving image data sent from a host computer 86. A serial interface such as USB, IEEE1394, Ethernet, wireless network, or a parallel interface such as a Centronics interface may be used as the communication interface 70. A buffer memory (not shown) may be mounted in this portion in order to increase the communication speed. The image data sent from the host computer 86 is received by the inkjet recording apparatus 10 through the communication interface 70, and is temporarily stored in the image memory 74. The image memory 74 is a storage device for temporarily storing images inputted through the communication interface 70, and data is written and read to and from the image memory 74 through the system controller 72. The image memory 74 is not limited to a memory composed of semiconductor elements, and a hard disk drive or another magnetic medium may be used.

The system controller 72 is a control unit for controlling the various sections, such as the communications interface 70, the image memory 74, the motor driver 76, the heater driver 78, and the like. The system controller 72 is constituted by a central processing unit (CPU) and peripheral circuits thereof, and the like, and in addition to controlling communications with the host computer 86 and controlling reading and writing from and to the image memory 74, or the like, it also generates a control signal for controlling the motor 88 of the conveyance system and the heater 89.

The motor driver (drive circuit) 76 drives the motor 88 in accordance with commands from the system controller 72. The heater driver (drive circuit) 78 drives the heater 89 of the post-drying unit 42 or the like in accordance with commands from the system controller 72.

The print controller 80 has a signal processing function for performing various tasks, compensations, and other types of processing for generating print control signals from the image data stored in the image memory 74 in accordance with commands from the system controller 72 so as to supply the generated control signal (print data) to the head driver 84. Prescribed signal processing is carried out in the print controller 80, and the ejection amount and the ejection timing of the ink droplets from the respective print heads 50 are controlled through the head driver 84, on the basis of the print data. By this means, prescribed dot size and dot positions can be achieved.

The print controller 80 is provided with the image buffer memory 82; and image data, parameters, and other data are temporarily stored in the image buffer memory 82 when image data is processed in the print controller 80. The aspect shown in FIG. 6 is one in which the image buffer memory 82 accompanies the print controller 80; however, the image memory 74 may also serve as the image buffer memory 82. Also possible is an aspect in which the print controller 80 and the system controller 72 are integrated to form a single processor.

The head driver 84 drives the pressure generating device of the print heads 50 of the respective colors on the basis of print data supplied by the print controller 80. The head driver 84 can be provided with a feedback control system for maintaining constant drive conditions for the print heads.

The print determination unit 24 is a block that includes the line sensor (not shown) as described above with reference to FIG. 1, reads the image printed on the recording paper 16, determines the print conditions (presence of the ejection, variation in the dot formation, and the like) by performing desired signal processing, or the like, and provides the determination results of the print conditions to the print controller 80.

According to requirements, the print controller 80 makes various corrections with respect to the print head 50 on the basis of information obtained from the print determination unit 24.

Next, the composition of the print head 50 which is characteristic of the present invention is described in detail.

Figure 7:
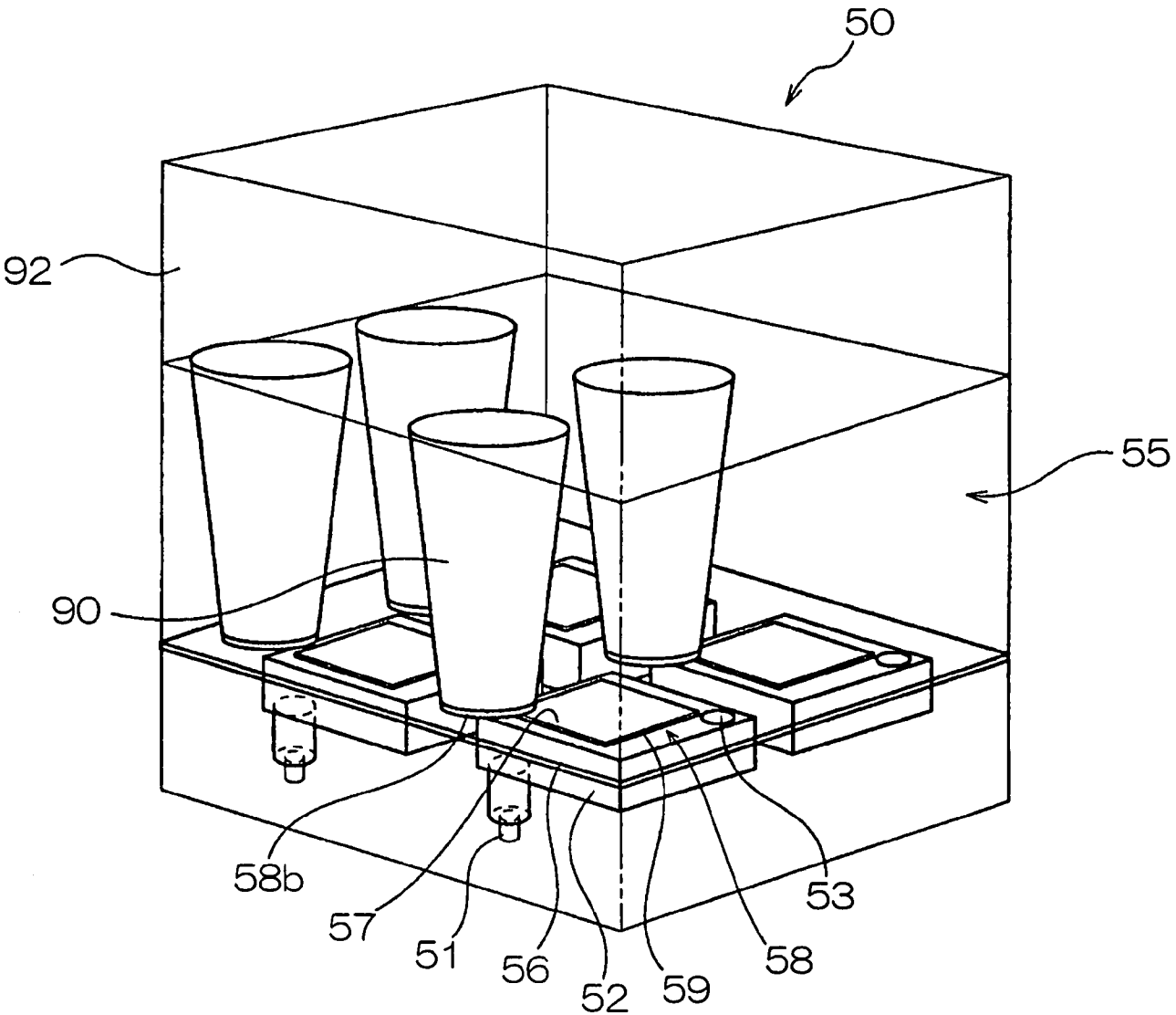
FIG. 7 is a plan view perspective diagram showing the approximate composition of a first embodiment of a print head.

FIG. 7 is a plan view perspective diagram showing the approximate composition of the print head 50 according to a first embodiment.

As shown in FIG. 7, a diaphragm 56 forming the upper face of the pressure chambers 52 is disposed over the pressure chambers 52 which each comprise the nozzle 51 and the ink supply port 53. The diaphragm 56 is composed as a single plate, and piezoelectric elements 58 which individually cause the pressure chambers 52 to deform are independently positioned on the diaphragm 56.

The piezoelectric elements 58 are constituted by piezoelectric bodies 59, and an individual electrode 57 is formed on the upper surface of each piezoelectric element 58. The diaphragm 56 functions as a common electrode for the piezoelectric elements 58, and the piezoelectric elements 58 are formed by arranging the piezoelectric bodies 59 between the diaphragm 56 and the individual electrodes 57. The piezoelectric element 58 principally includes a movable portion 58*a* for causing the pressure chamber 52 to deform and an electrical connection portion 58*b* for connecting an electrical wire 90. The movable portion 58*a* is formed in a substantially square shape, and is disposed in the region where the corresponding pressure chamber 52 is formed. On the other hand, the electrical connection portion 58*b* is formed by extending the piezoelectric element 58 in a lateral direction from one corner of the movable portion 58*a*, through an extension portion 58*c*, and is disposed in a region outside the region where the pressure chamber 52 is formed. The electrical connection portion 58*b* is formed in a circular shape, and the column-shaped electrical wire 90 is formed thereon, rising upward in a substantially vertical fashion.

The wiring plate 92 is disposed on top of the column-shaped electrical wires (also called "electrical columns" due to their shape) 90, and drive signals are supplied to the individual electrodes 57 of the piezoelectric elements 58 from the head driver 84 described above, through the wires formed in the wiring plate 92.

The space through which these column-shaped electrical wires 90 are erected functions as a common liquid chamber 55 for supplying the ink to the pressure chambers 52, and the ink is supplied to the pressure chambers 52 from the common liquid chamber 55 through the ink supply ports 53 of the pressure chambers 52. Therefore, the length of the flow path connecting the common liquid chamber 55 of sufficient capacity, with the pressure chambers 52, is shortened, which is beneficial in terms of improving refilling and ejecting liquid of high viscosity.

The common liquid chamber 55 shown in FIG. 7 is formed as a single space, but it is also possible to divide the common liquid chamber 55 into several regions.

The electrical wires 90 shown in FIG. 7 are formed in a one-to-one correspondence with respect to the piezoelectric elements 58. In order to reduce the number of wires, it is also possible to gather the wires for several piezoelectric elements 58 into one body and to form them as one electrical wire 90. The wiring to the common electrode (the diaphragm 56) may also be formed as the electrical wire 90, in addition to those connected to the individual electrodes 57.

Figure 8:
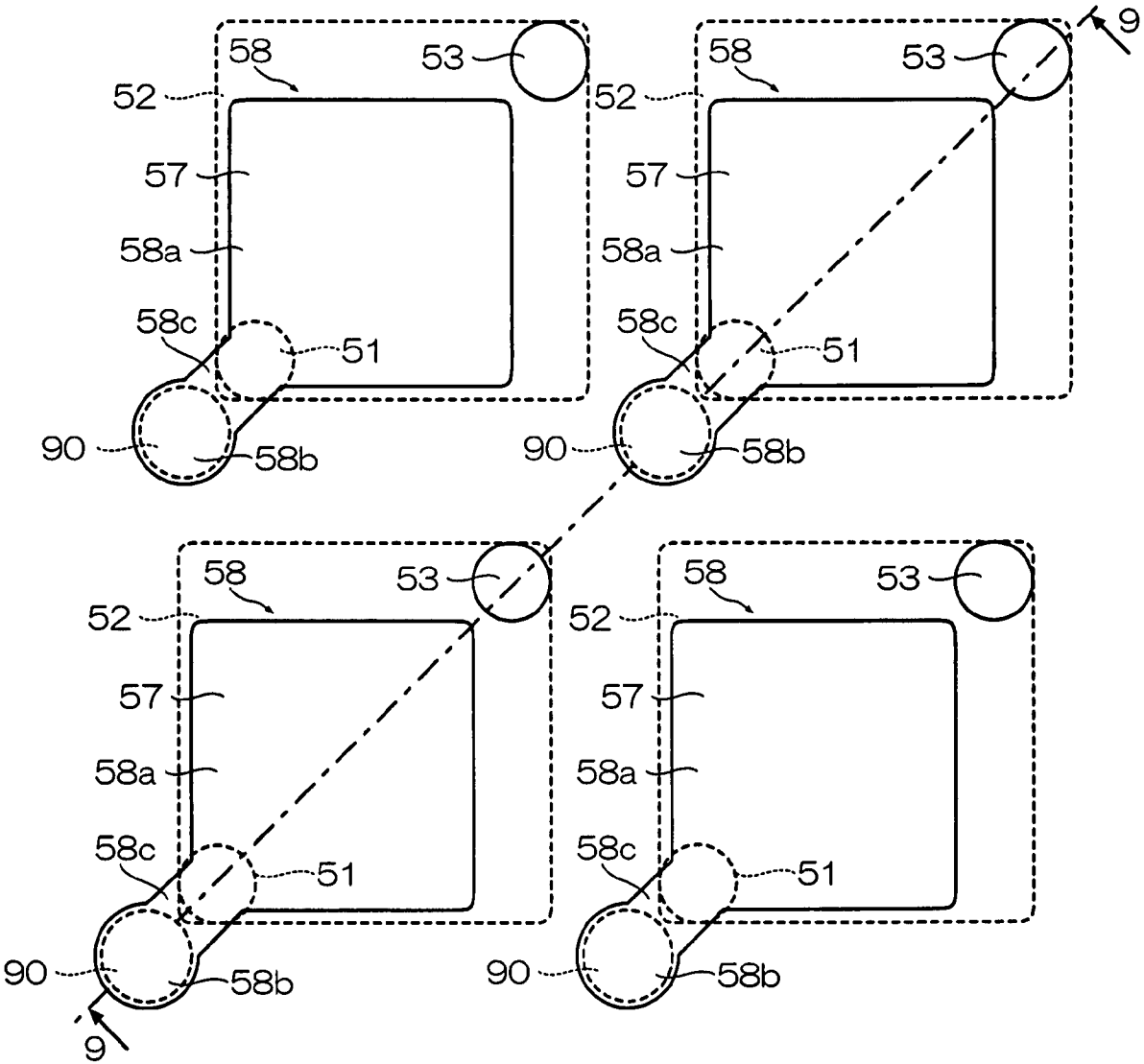
FIG. 8 is a plan view perspective diagram showing an enlarged view of a portion of the pressure chambers.

FIG. 8 shows an enlarged plan view perspective diagram of a portion of the pressure chambers 52. As shown in FIG. 8, each of the pressure chambers 52 is formed in a substantially square shape, and the nozzle 51 and the ink supply port 53 are formed at respective corners of a diagonal of the pressure chamber 52.

Figure 9:
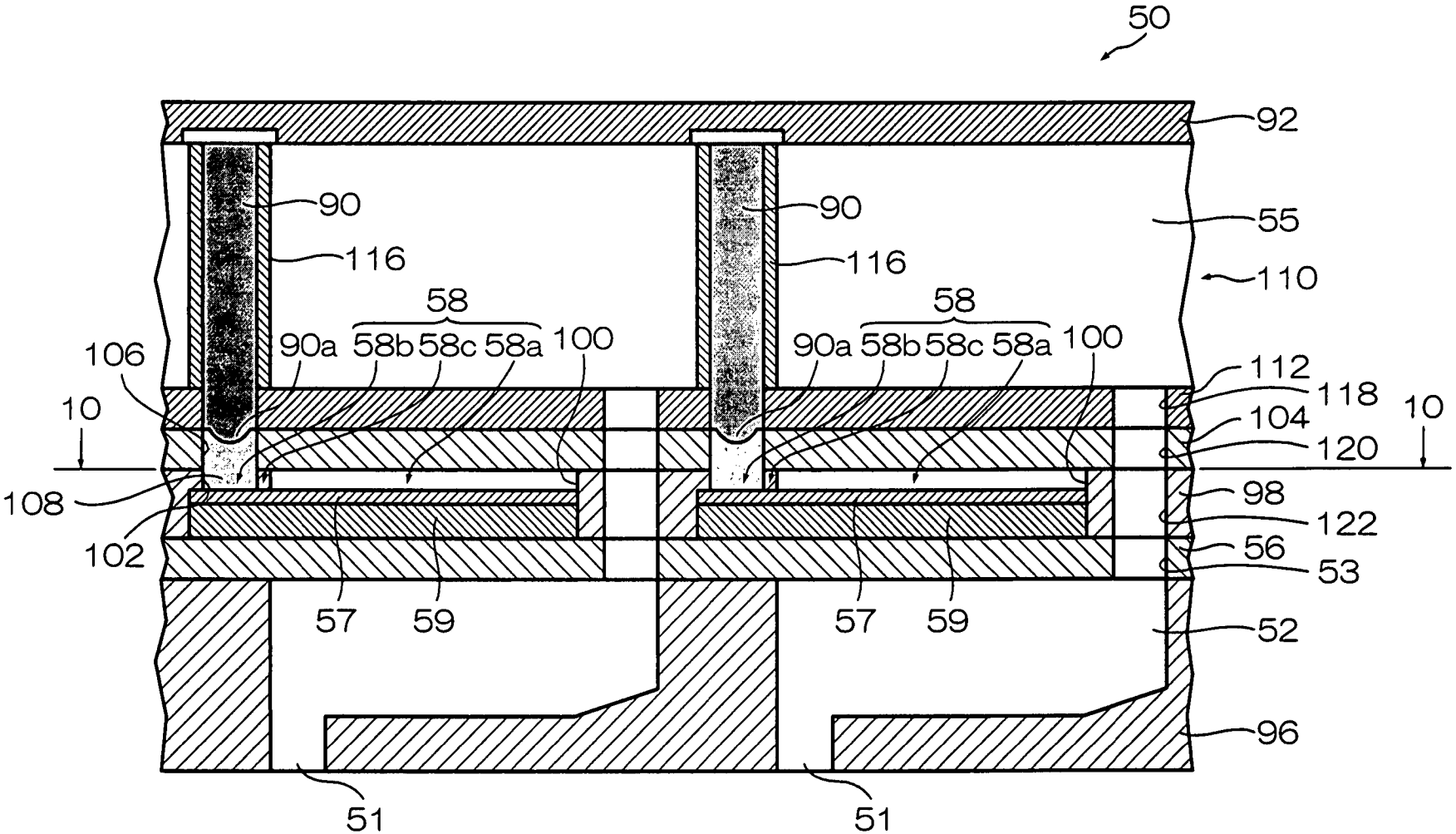
FIG. 9 is a cross-sectional diagram along line 9-9 in FIG. 8.

FIG. 9 is a cross-sectional diagram along line 9-9 in FIG. 8. As shown in FIG. 9, the nozzles 51 and the pressure chambers 52 are formed in a flow channel plate 96 and the diaphragm 56 is bonded on top of the flow channel plate 96. As described above, the diaphragm 56 is formed as the single plate, and the ceiling face of the pressure chambers 52 is constituted by the diaphragm 56. Furthermore, the diaphragm 56 is formed with the ink supply ports 53 which connect to the pressure chambers 52.

The piezoelectric elements 58 are disposed on the diaphragm 56 at positions corresponding to the pressure chambers 52, and a resist layer 98 is formed so as to surround the piezoelectric elements 58.

Figure 10:
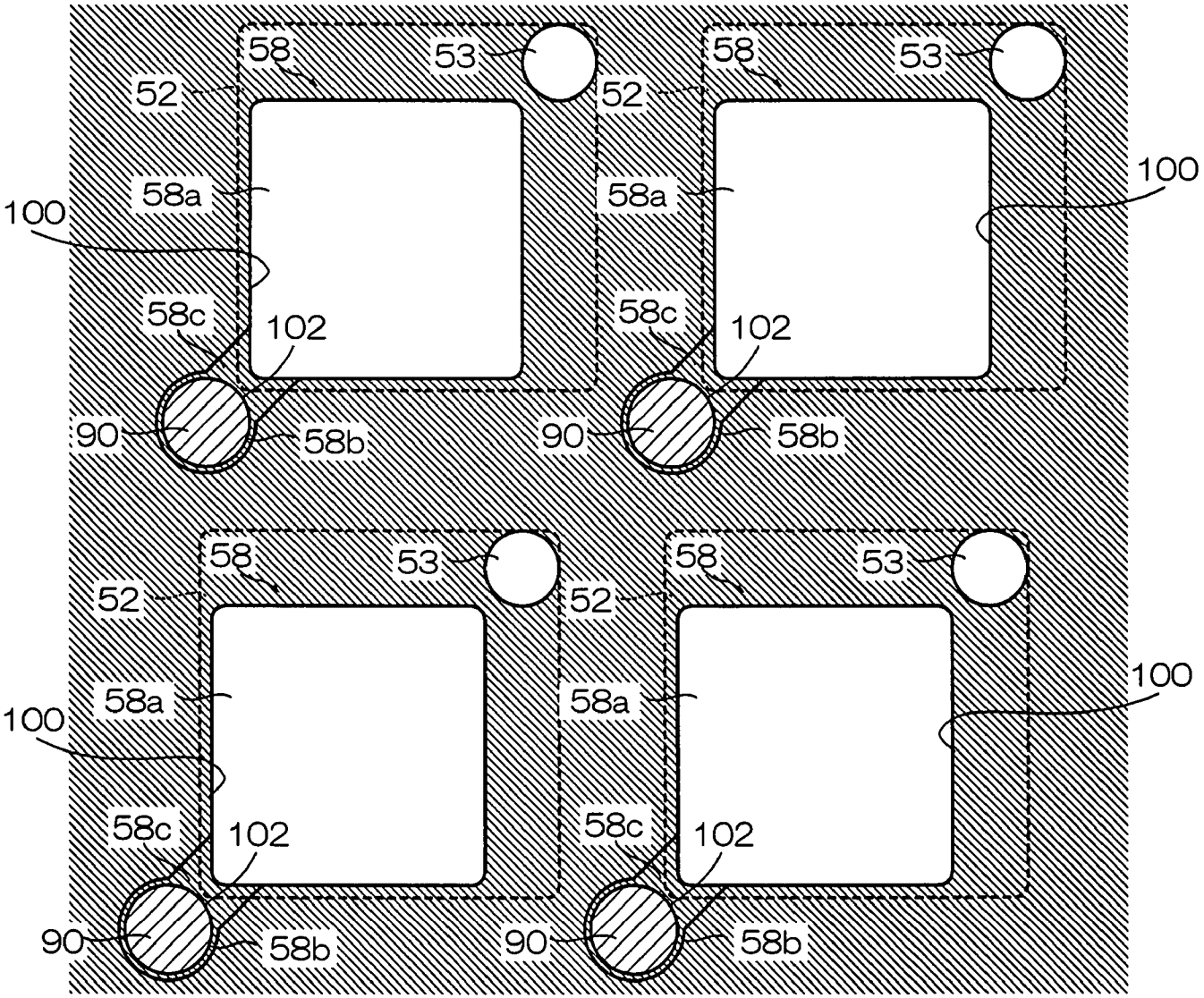
FIG. 10 is a cross-sectional diagram along line 10-10 in FIG. 9.

Here, the resist layer 98 is formed slightly more thickly than the thickness of the piezoelectric elements 58, and there is no resist at parts over the movable portion 58*a* and the electrical connection portion 58*b* of each piezoelectric element 58. The space formed over the movable portion 58*a* of the piezoelectric element 58 functions as a movement space 100, namely a space which ensures the free displacement of the piezoelectric element 58. The space formed over the electrical connection portion 58*b* functions as a connection space 102, namely, a space which guarantees the connection between the electrical wire 90 and the electrical connection portion 58*b*. As shown in FIG. 10, the movement spaces 100 and the connection spaces 102 are separated from each other by the resist layer 98.

A cover plate 104 which covers the upper portion of the piezoelectric element 58 is bonded onto the resist layer 98. The cover plate 104 is constituted by a single plate, and is formed with through holes 106 in positions corresponding to the connection spaces 102 formed in the resist layer 98. The through holes 106 are formed to substantially the same diameter as the connection spaces 102, and are connected to the connection spaces 102. A conductive adhesive 108 is filled in the through holes 106 and the connection spaces 102, and connections with the electrical connection portions 58*b* are guaranteed through the conductive adhesive 108.

A common liquid chamber section 110 which constitutes the common liquid chamber 55 is bonded onto the cover plate 104. The common liquid chamber section 110 is constituted by an insulating plate 112, the electrical wires 90 and the wiring plate 92.

The insulating plate 112 is constituted as a single insulating plate forming the common liquid chamber 55, and is formed with through holes 114 at positions corresponding to the through holes 106 formed in the cover plate 104.

The electrical wires 90 are formed so as to extend vertically from the through holes 114 formed in the insulating plate 112, and the outer circumferences of the electrical wires 90 are covered with insulating sections 116. The lower end section of each electrical wire 90 is formed with a hemispherical projection 90*a* creating a bump, which projects from the through hole 114 formed in the insulating plate 112.

The wiring plate 92 is constituted by one plate on which an insulating film is formed on the surface forming the common liquid chamber 55, and is disposed on the tips of the electrical wires 90. Wires (not illustrated) are formed in the wiring plate 92, and these wires are connected to the electrical wires 90.

The common liquid chamber 55 is formed by the space in which the electrical wires 90 rise upward between the insulating plate 112 and the wiring plate 92, and the ink pooled inside the common liquid chamber 55 is supplied to the pressure chambers 52. Therefore, through holes 118, 120 and 122 for connecting the common liquid chamber 55 and the pressure chambers 52 are formed in the insulating plate 112, the resist layer 98 and the diaphragm 56, which are provided between the common liquid chamber 55 and the pressure chambers 52. These through holes 118, 120 and 122 are formed at positions corresponding to the ink supply ports 53 formed in the flow channel plate 96, and the ink inside the common liquid chamber 55 is supplied to the pressure chambers 52 from the ink supply ports 53 through the through holes 118, 120 and 122.

Furthermore, when the common liquid chamber section 110 forming the common liquid chamber 55 is bonded onto the cover plate 104, the projections 90*a* at the tips of the electrical wires 90 fit in the through holes 106 formed in the cover plate 104, and are bonded to the conductive adhesive 108 filled in the through holes 106. Thereby, the electrical wires 90 and the conductive adhesive 108 are electrically connected, and the electrical wires 90 and the piezoelectric elements 58 become electrically connected by means of the conductive adhesive 108. Consequently, it is possible to apply drive signals to the piezoelectric elements 58, from the wiring plate 92. Therefore, desirably, the conductive adhesive 108 hardens simultaneously with the bonding of the common liquid chamber section 110.

According to the print head 50 of the present embodiment having the composition described above, the peripheral area of each piezoelectric element 58 is sealed and filled with the resist. Thereby, it is possible effectively to prevent leakage currents, as well as ensuring reliability in the electric connections. In this case, since the resist is a soft material, it has very little adverse effect on the displacement of the piezoelectric element 58, and therefore stable operation can be achieved.

Furthermore, since the movable portion 58*a* and the electrical connection portion 58*b* of each piezoelectric element 58 are separated completely by means of the movement space 100 and the connection space 102 formed in the resist layer 98, it is then easy to provide the connection portion for the piezoelectric element 58, without protrusion of the conductive adhesive 108, and therefore the manufacturing process can be simplified. Below, a method of manufacturing the print head 50 is described.

FIGS. 11A to 11G are illustrative diagrams of a manufacturing process for the print head 50 according to the first embodiment.

Figure 11A:
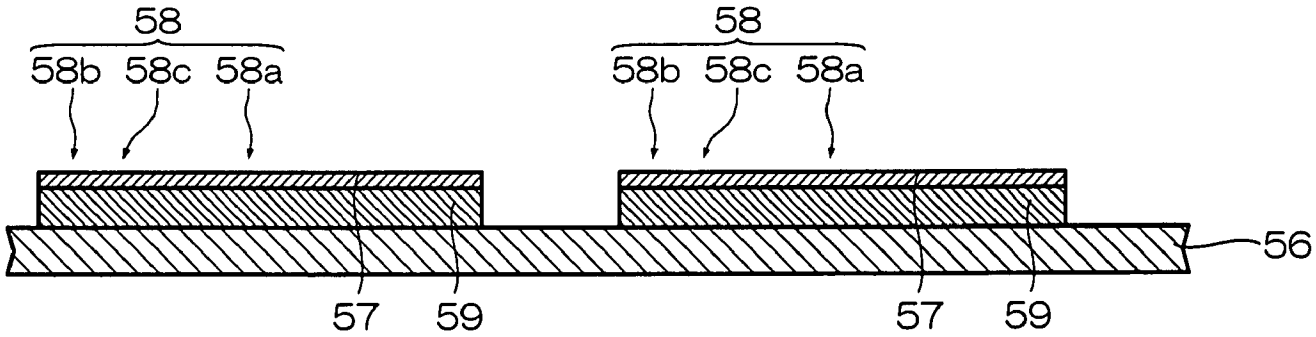
FIGS. 11A to 11G are illustrative diagrams of a manufacturing process for the print head according to the first embodiment.

Firstly, as shown in FIG. 11A, the piezoelectric elements 58 are disposed at prescribed positions on the diaphragm 56.

Figure 11B:
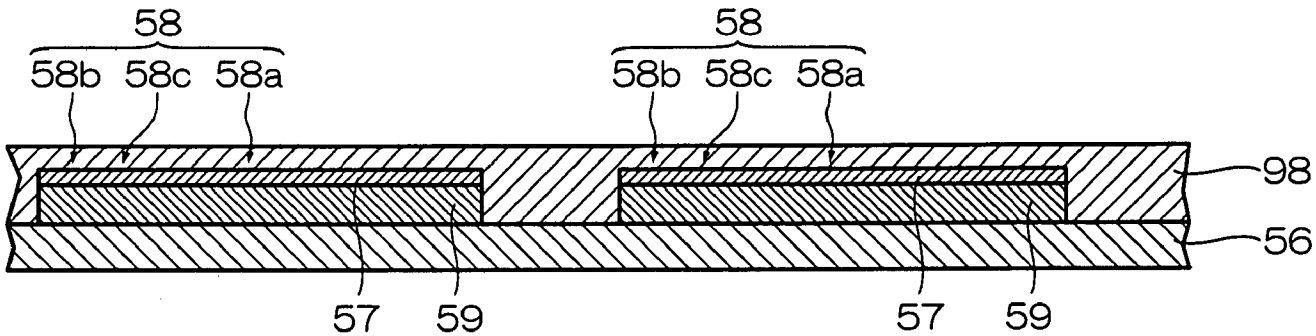

Thereupon, as shown in FIG. 11B, liquid resist is applied to the diaphragm 56 on which the piezoelectric elements 58 have been disposed. The applied resist is cured by baking, thereby forming the resist layer 98 on top of the diaphragm 56.

The applied resist is leveled to be slightly thicker than the piezoelectric elements 58, in such a manner that the piezoelectric elements 58 disposed on the diaphragm 56 are covered with the resist. There are no particular restrictions on the method of application used, and a method such as spin coating, spray coating, bar coating, or the like, may be used.

Figure 11C:
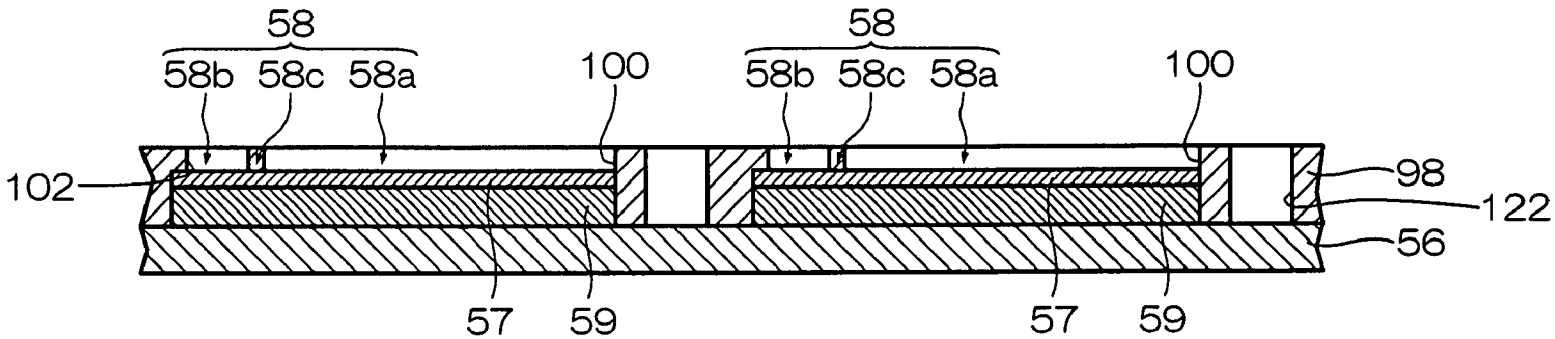

Thereupon, as shown in FIG. 11C, the resist covering over the movable portions 58*a* of the piezoelectric elements 58, the electrical connection portions 58*b*, and the positions where the ink supply ports 53 are to be formed, is exposed, developed and removed, thereby forming the movement spaces 100, the connection spaces 102 and the through holes 122 in the resist layer 98.

Figure 11D:
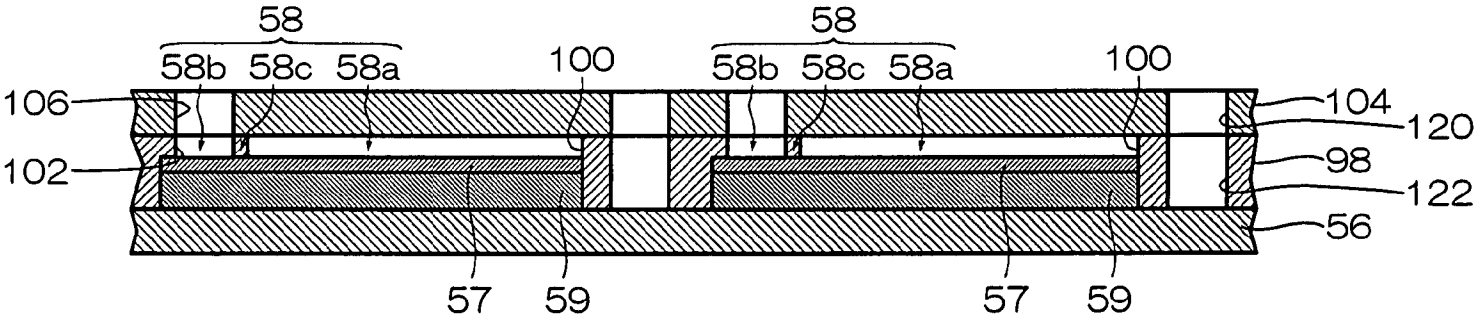

Thereupon, as shown in FIG. 11D, the cover plate 104 formed with the through holes 106 and 120 in the positions where the connection spaces 102 and the through holes 122 are formed, is bonded on top of the resist layer 98.

There are no particular restrictions on the method of bonding the cover plate 104, and the cover plate 104 may be bonded onto the resist layer 98 using an adhesive, for example. Besides this, the cover plate 104 may also be bonded by using diffusion bonding, or the like.

Furthermore, there are no particular restrictions on the method of forming the through holes 106 and 120 in the cover plate 104, and for example, the through holes 106 and 120 are formed at prescribed positions by laser processing. Besides this, it is also possible to form the through holes 106 and 120 by an etching process, or the like.

Figure 11E:
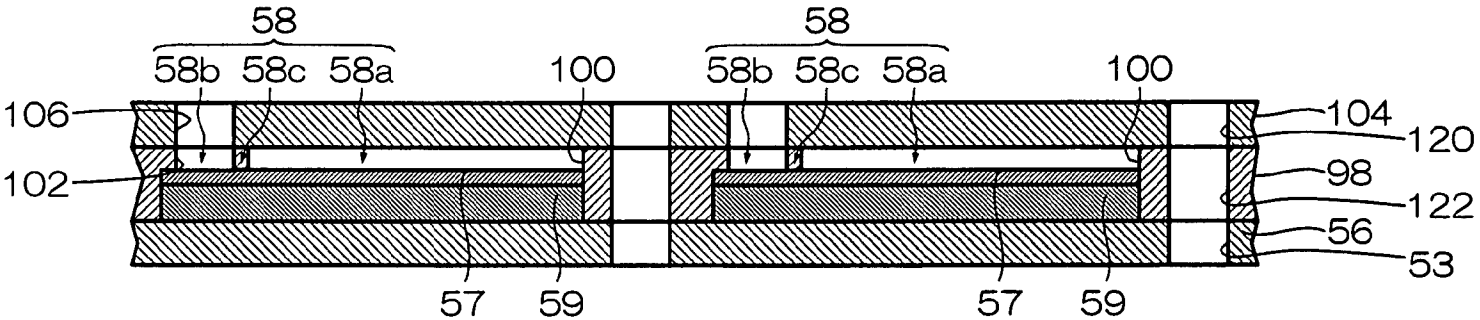

Next, as shown in FIG. 11E, the ink supply ports 53 are opened in the diaphragm 56. There are no particular restrictions on the processing method used for this, and for example, the ink supply ports 53 are formed by laser processing. Besides this, the ink supply ports 53 may also be formed by a dry etching process.

Figure 11F:
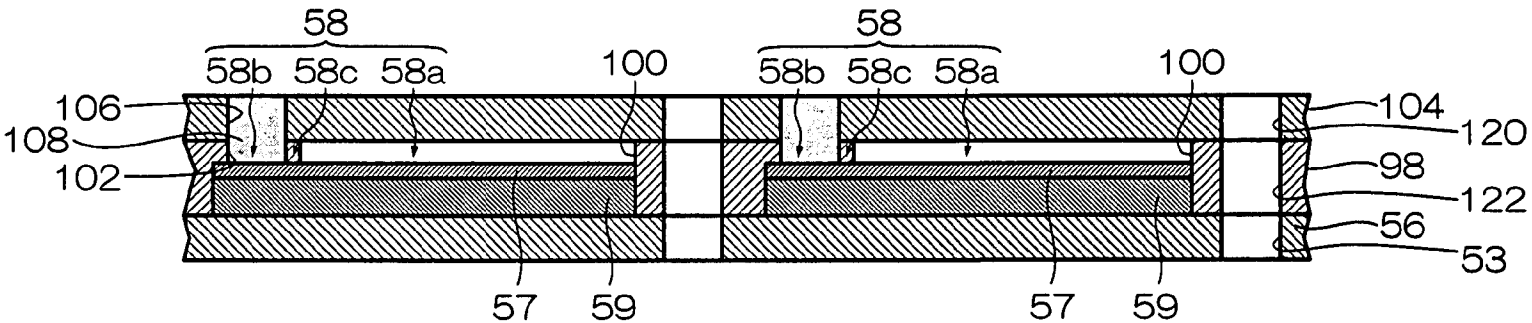

Thereupon, as shown in FIG. 11F, the conductive adhesive 108 is filled into the connection spaces 102 formed in the resist layer 98, and the through holes 106 of the cover plate 104, which connect to the connection spaces 102. There are no particular restrictions on the method of filling the conductive adhesive 108, and desirably, the conductive adhesive 108 is introduced by screen printing (including vacuum printing). By this means, a large number of holes can be filled reliably, without exerting pressure on the piezoelectric elements 58, and without creating voids.

Instead of the conductive adhesive 108, it is also possible to fill a conductive paste or a conductive ink, or the like, into the through holes 106 and the connection spaces 102. Here, the conductive adhesive, conductive paste and conductive ink include a material in which conductive particles are dispersed in a binder resin, and the dispersed particles are made to connect together by the curing and contraction of the binder resin, thereby creating conductive properties.

Figure 11G:
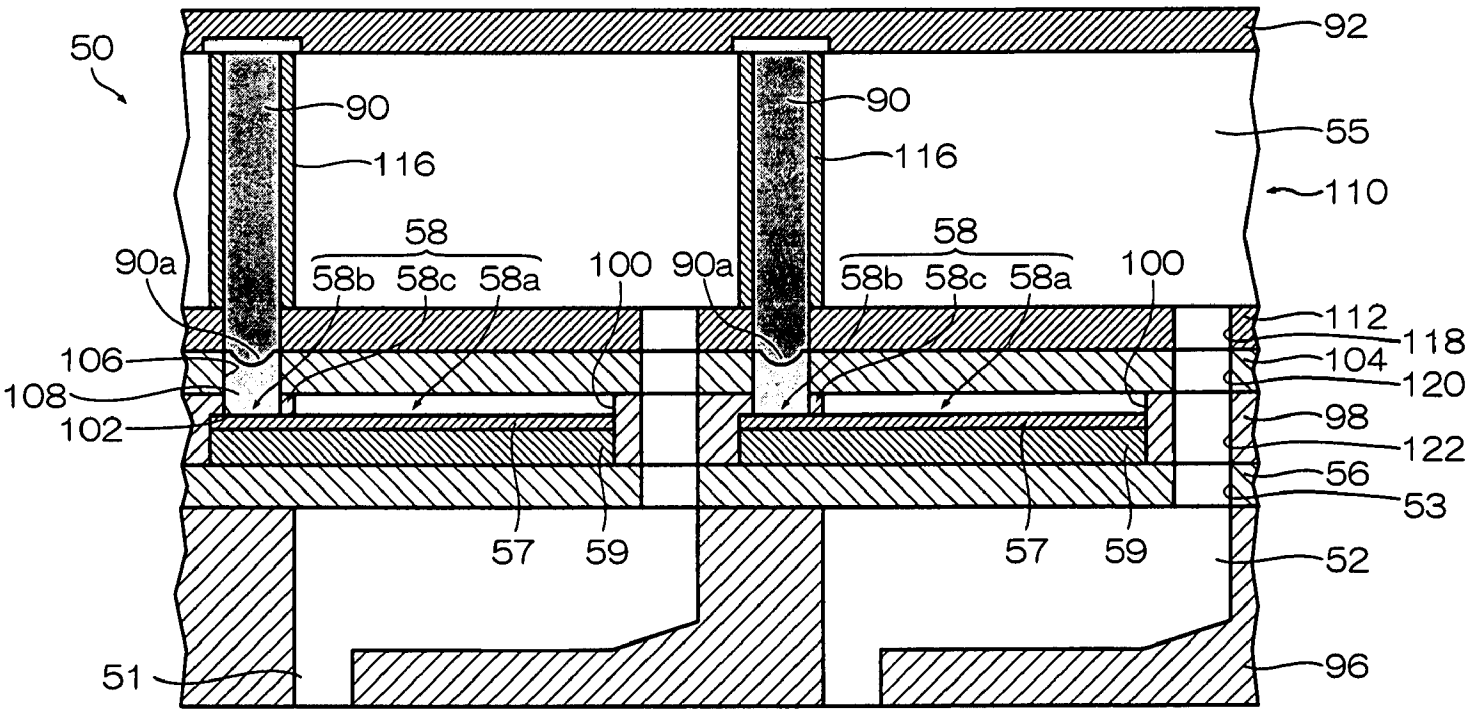

Next, as shown in FIG. 11G, the common liquid chamber section 110, which has been separately manufactured, is bonded on top of the cover plate 104, and the flow channel plate 96 is bonded onto the bottom of the diaphragm 56.

Here, the common liquid chamber section 110 is bonded onto the cover plate 104 before the conductive adhesive 108 filled in the through holes 106 and the connection spaces 102 has solidified. There are no particular restrictions on the method of bonding the common liquid chamber section 110, and the common liquid chamber section 110 may be bonded onto the cover plate 104 by using an adhesive, for example. Besides this, the common liquid chamber section 110 may also be bonded onto the cover plate 104 by welding, or the like. Furthermore, there are no particular restrictions on the method of bonding the flow channel plate 96, and the flow channel plate 96 may be bonded onto the diaphragm 56 by using an adhesive, for example. Besides this, the flow channel plate 96 may also be bonded onto the diaphragm 56 by diffusion bonding, or the like.

The print head 50 according to the first embodiment is manufactured by means of the series of steps described above. In the thus manufactured print head 50, the electrical connection portion 58*b* and the movable portion 58*a* of each piezoelectric element 58 are completely separated from each other and the periphery of each piezoelectric element 58 is sealed with the resist. Therefore, it is possible effectively to prevent leakage currents and to ensure the reliability of the electrical connections. In this case, since the resist is a soft material, it has very little adverse effect on the displacement of the piezoelectric element 58, and therefore stable operation can be achieved.

Furthermore, since the conductive adhesive 108 is filled into the through holes 106 and the connection spaces 102 by screen printing, then it is possible to carry out a plurality of filling tasks reliably, without exerting undue force on the piezoelectric elements 58. Moreover, in this case, since the electrical connection portions 58*b* and the movable portions 58*a* are completely separated, it is easy to fill the conductive adhesive 108 into the through holes 106 and the connection spaces 102, and therefore the manufacturing process can be simplified.

Figure 12:
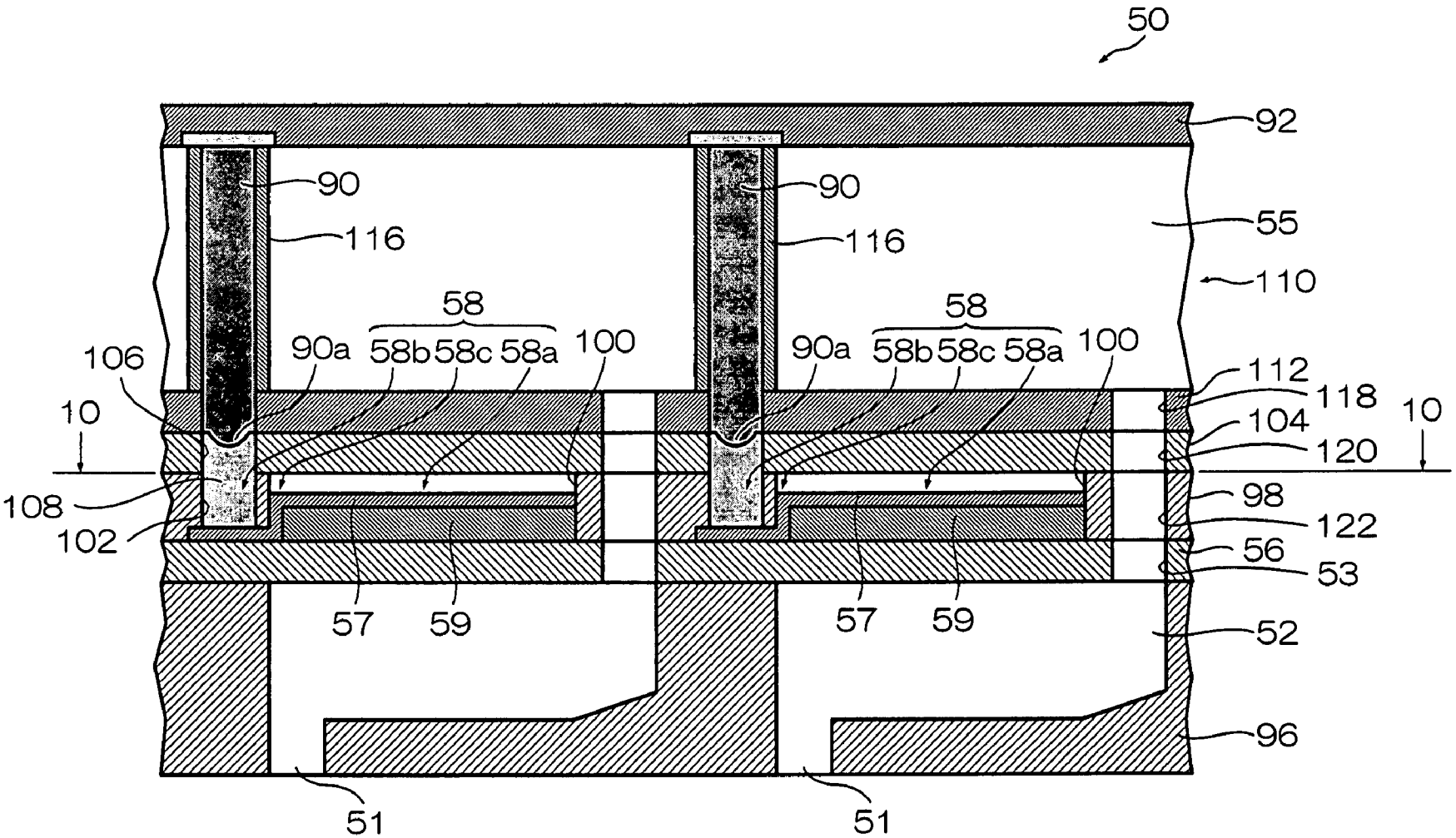
FIG. 12 is a cross-sectional diagram showing the principal composition of a further embodiment of the print head.

As shown in FIG. 12, the electrical connection portions 58*b* may be formed in such a manner that only the individual electrode 57 extends in the lateral direction from the piezoelectric body 59.

Next, a print head according to a second embodiment of the present invention is described.

Figure 13:
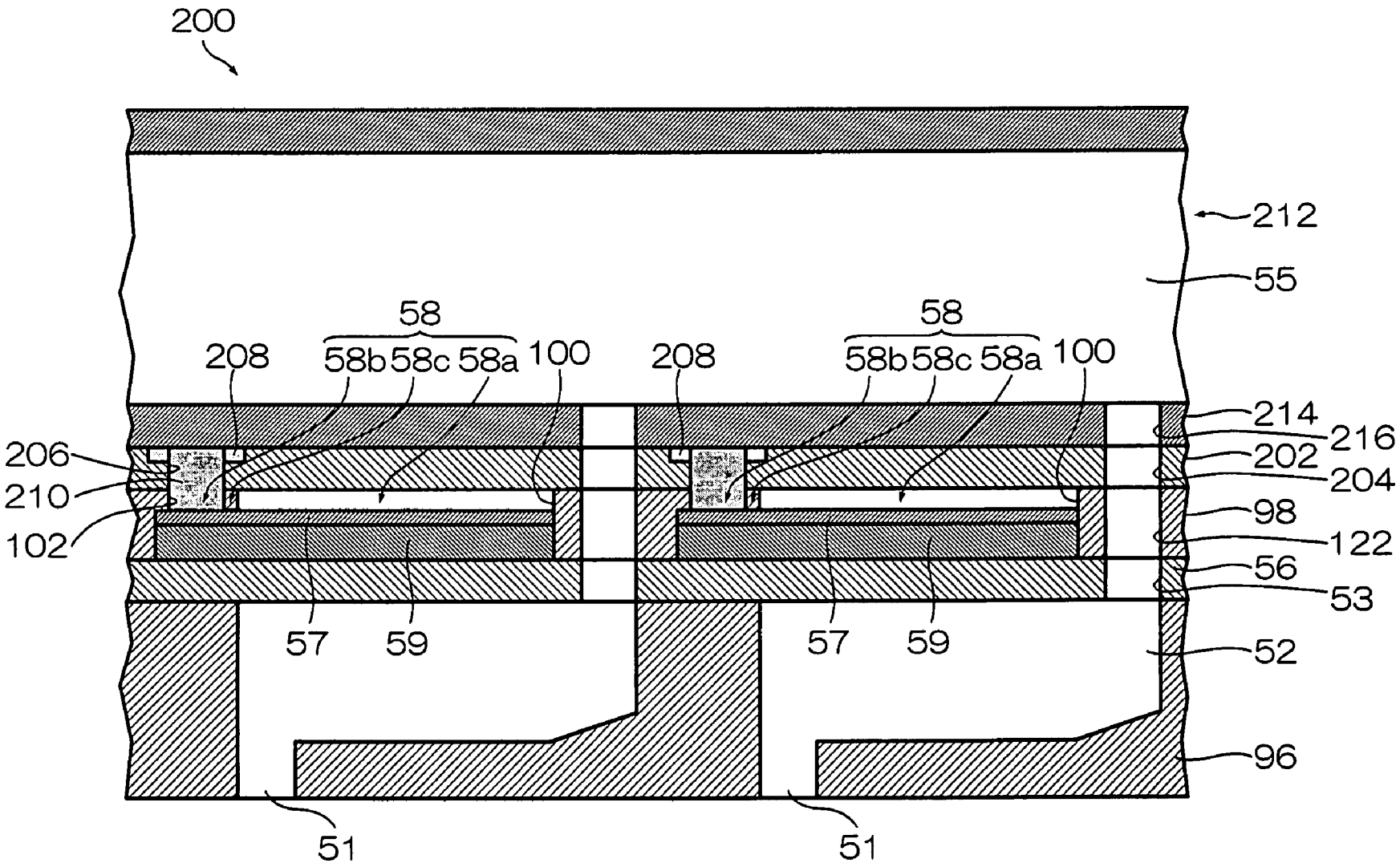
FIG. 13 is a cross-sectional diagram showing the composition of the principal part of a print head according to a second embodiment.

FIG. 13 is a cross-sectional diagram showing the composition of the principal part of the print head according to the second embodiment.

As shown in FIG. 13, in the print head 200 according to the second embodiment, electrical wires for applying drive voltages to the piezoelectric elements 58 are formed between the common liquid chamber 55 and the resist layer 98. These electrical wires are formed on a wiring plate 202, which is positioned between the common liquid chamber 55 and the resist layer 98.

Apart from this, the remainder of the composition is basically the same as that of the print head 50 of the first embodiment, and therefore, the same reference numerals are assigned to constituent members which are the same as the print head 50 of the first embodiment, and further description thereof is omitted here.

As shown in FIG. 13, the wiring plate 202 is bonded on the resist layer 98, in which the movement spaces 100, the connection spaces 102 and the through holes 122 are formed.

The wiring plate 202 is constituted as a single plate, and is formed with through holes. 204 and 206 at positions corresponding to the through holes 122 formed in the resist layer 98 and at positions corresponding to the connection spaces 102.

The through holes 204 are formed to substantially the same diameter as the through holes 122 formed in the resist layer 98, and the through holes 204 connect with the through holes 122.

On the other hand, the through holes 206 are formed to substantially the same diameter as the connection spaces 102 formed in the resist layer 98, and the through holes 206 connect with the connection spaces 102. Land portions 208 for the electrical wires (not shown) which are laid over the upper surface of the wiring plate 202 are formed on the upper end portions of the through holes 206.

A conductive adhesive (or a conductive paste) 210 is filled into the through holes 206 formed in the wiring plate 202, and the connection spaces 102 formed in the resist layer 98, and the land portions 208 and the electrode pads 59 are connected electrically through the conductive adhesive 210.

A common liquid chamber section 212 is bonded on top of the wiring plate 202. The common liquid chamber section 212 is formed in a box shape and the common liquid chamber 55 is formed inside same. Through holes 216 are formed in a lower surface plate 214 which forms the lower surface of the common liquid chamber section 212, at positions corresponding to the through holes 204 formed in the wiring plate 202, and the through holes 216 connect with the through holes 204. The common liquid chamber 55 is connected to the pressure chambers 52 by means of the through holes 216 formed in the lower surface plate 214, the through holes 204 formed in the wiring plate 202, the through holes 122 formed in the resist layer 98, and the ink supply ports 53 formed in the diaphragm 56.

In the print head 200 according to the second embodiment having this composition, similarly to the print head 50 according to the first embodiment, the piezoelectric elements 58 are sealed in a state where the peripheral regions of the piezoelectric elements 58 are filled with the resist, and therefore, it is possible effectively to prevent leakage currents, as well as ensuring reliable driving of the piezoelectric elements.

Furthermore, since the movable portion and the electrical connection portion of each piezoelectric element 58 are separated completely by means of the movement spaces 100 and the connection spaces 102 formed in the resist layer 98, it is easy to provide the connection portions for the piezoelectric elements 58, and therefore the manufacturing process can be simplified.

Below, a method of manufacturing the print head 200 according to the second embodiment is described.

FIGS. 14A to 14G are illustrative diagrams of a manufacturing process for the print head 200 according to the second embodiment.

Figure 14A:
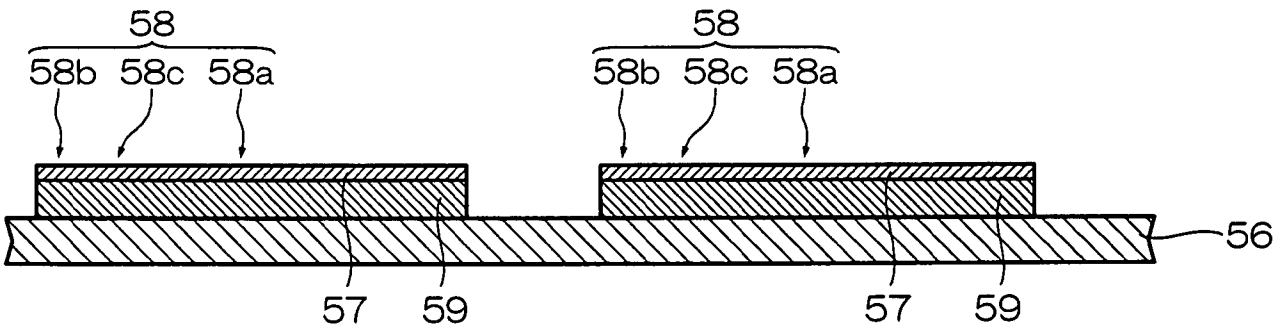
FIGS. 14A to 14G are illustrative diagrams of a manufacturing process for the print head according to the second embodiment.

Firstly, as shown in FIG. 14A, the piezoelectric elements 58 are disposed at prescribed positions on the diaphragm 56.

Figure 14B:
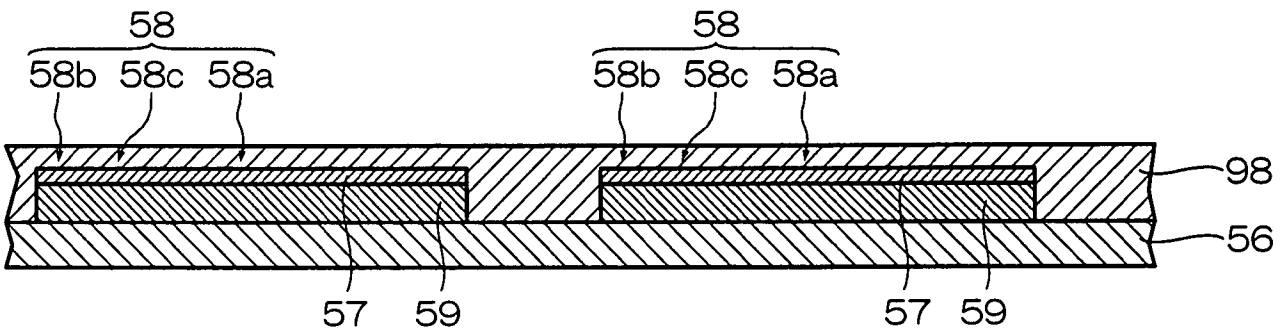

Thereupon, as shown in FIG. 14B, liquid resist is applied to the diaphragm 56 on which the piezoelectric elements 58 have been disposed. The applied resist is cured by baking, thereby forming the resist layer 98 on top of the diaphragm 56.

The applied resist is leveled to be slightly thicker than the piezoelectric elements 58, in such a manner that the piezoelectric elements 58 disposed on the diaphragm 56 are covered with the resist. There are no particular restrictions on the method of application used, and a method such as spin coating, spray coating, bar coating, or the like, may be used.

Figure 14C:
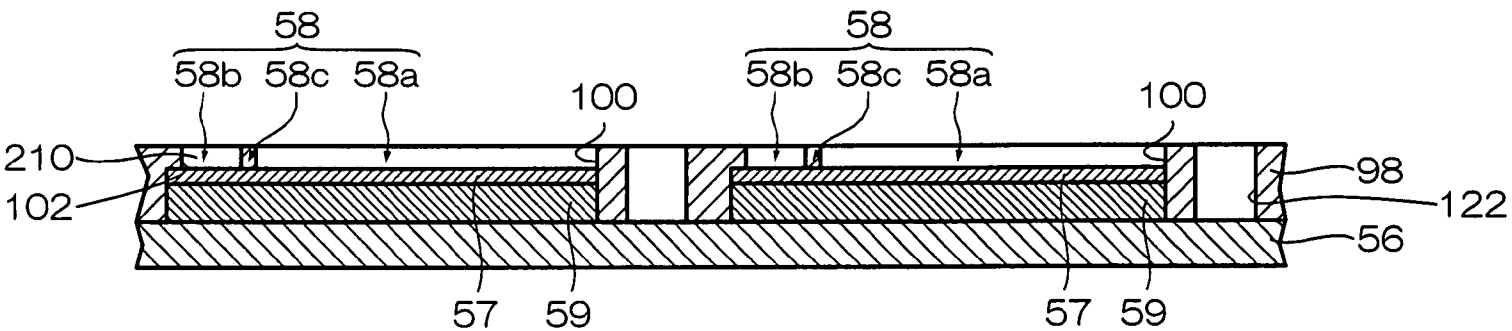

Thereupon, as shown in FIG. 14C, the resist covering over the movable portions 58*a* of the piezoelectric elements 58, the electrical connection portions 58*b*, and the positions where the ink supply ports 53 are to be formed, is exposed, developed and removed, thereby forming the movement spaces 100, the connection spaces 102 and the through holes 122 in the resist layer 98.

Figure 14D:
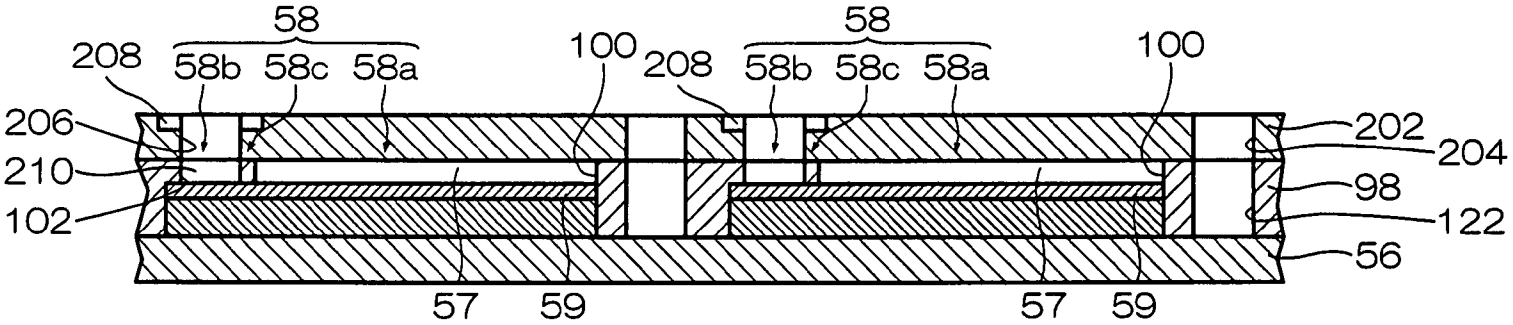

Thereupon, as shown in FIG. 14D, the wiring plate 202 formed with the through holes 204 and 206 in the positions where the connection spaces 102 and the through holes 122 are formed, is bonded on top of the resist layer 98.

There are no particular restrictions on the method of bonding the wiring plate 202, and the wiring plate 202 may be bonded onto the resist layer 98 by using an adhesive, for example. Besides this, the wiring plate 202 may also be bonded by using diffusion bonding, or the like.

Furthermore, there are no particular restrictions on the method of forming the through holes 204 and 206 in the wiring plate 202, and for example, the through holes 204 and 206 are formed at prescribed positions by laser processing. Besides this, it is also possible to form the through holes 204 and 206 by an etching process, or the like.

Figure 14E:
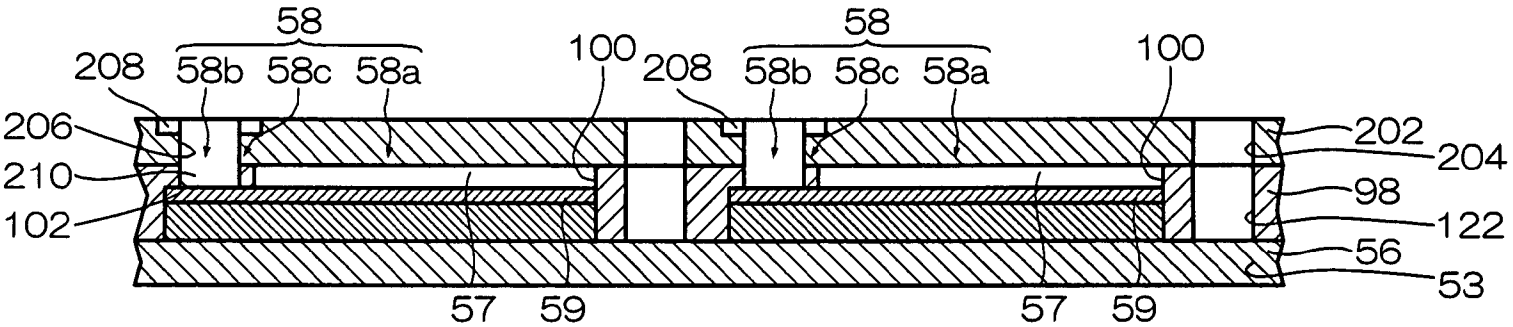

Thereupon, as shown in FIG. 14E, conductive adhesive 210 is filled into the connection spaces 102 formed in the resist layer 98 and the through holes 206 formed in the wiring plate 202, thereby creating electrical connections between the land portions 208 and the electrical connection portions 58*b*.

There are no particular restrictions on the method of filling the conductive adhesive 210, and desirably, the conductive adhesive 210 is introduced by screen printing (including vacuum printing), similarly to the print head 50 according to the first embodiment. By this means, a large number of holes can be filled reliably, without exerting pressure on the piezoelectric elements 58.

Moreover, instead of the conductive adhesive 210, it is also possible to fill a conductive paste into the through holes 206 and the connection spaces 102.

Figure 14F:
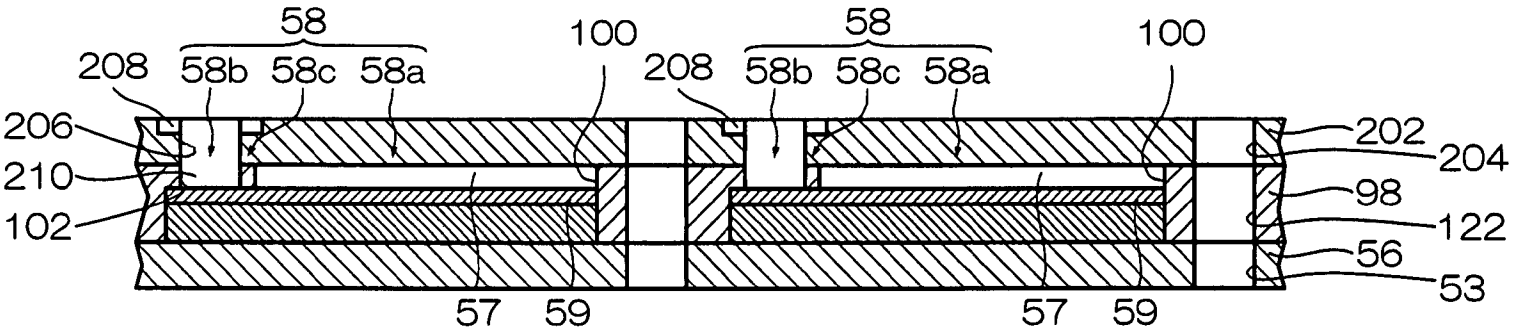

Next, as shown in FIG. 14F, the ink supply ports 53 are opened in the diaphragm 56. There are no particular restrictions on the processing method used for this, and for example, the ink supply ports 53 are formed by laser processing. Besides this, the ink supply ports 53 may also be formed by a dry etching process.

Figure 14G:
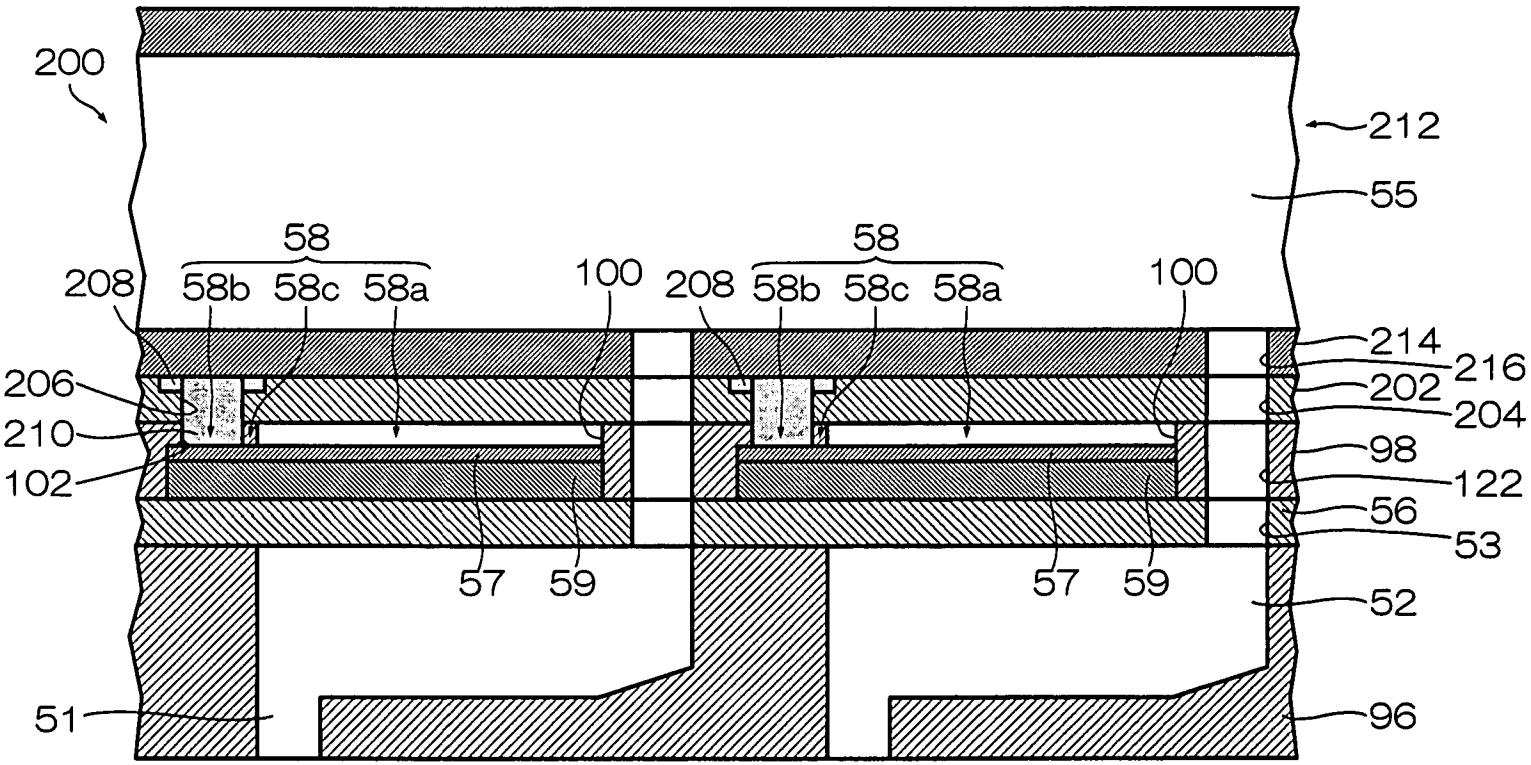

Next, as shown in FIG. 14G, the common liquid chamber section 212, which has been separately manufactured, is bonded on top of the wiring plate 202, and the flow channel plate 96 is bonded onto the bottom of the diaphragm 56. There are no particular restrictions on the method of bonding the common liquid chamber section 212, and the common liquid chamber section 212 may be bonded onto the wiring plate 202 by using an adhesive, for example. Besides this, the common liquid chamber section 212 may also be bonded onto the wiring plate 202 by welding, or the like. Furthermore, there are no particular restrictions on the method of bonding the flow channel plate 96, and the flow channel plate 96 may be bonded onto the diaphragm 56 by using an adhesive, for example. Besides this, the flow channel plate 96 may also be bonded onto the diaphragm 56 by diffusion bonding, or the like.

The print head 200 according to the second embodiment is manufactured by means of the series of steps described above. In the thus manufactured print head 200, similarly to the print head 50 according to the first embodiment, since the electrical connection portion 58*b* and the movable portion 58*a* of each piezoelectric element 58 are sealed in a completely separated state, then it is possible to prevent leakage currents effectively, as well as ensuring reliability in the electrical connections. In this case, since the resist is a soft material, it has very little adverse effect on the displacement of the piezoelectric element 58, and therefore stable operation can be achieved.

Furthermore, since the conductive adhesive 210 is filled into the through holes 206 and the connection spaces 102 by screen printing, then it is possible to carry out a plurality of filling tasks reliably, without exerting undue force on the piezoelectric elements 58. Moreover, in this case, since the electrical connection portions 58*b* and the movable portions 58*a* are completely separated, it is easy to fill the conductive adhesive 210 into the through holes 206 and the connection spaces 102, and therefore the manufacturing process can be simplified.

Furthermore, in the present embodiment, it is possible to perform the bonding and the connection of the wiring plate 202 separately, and therefore, better reliability is achieved. Moreover, the structure is simple and bubbles are not liable to remain.

Next, a print head according to a third embodiment of the present invention is described.

Figure 15:
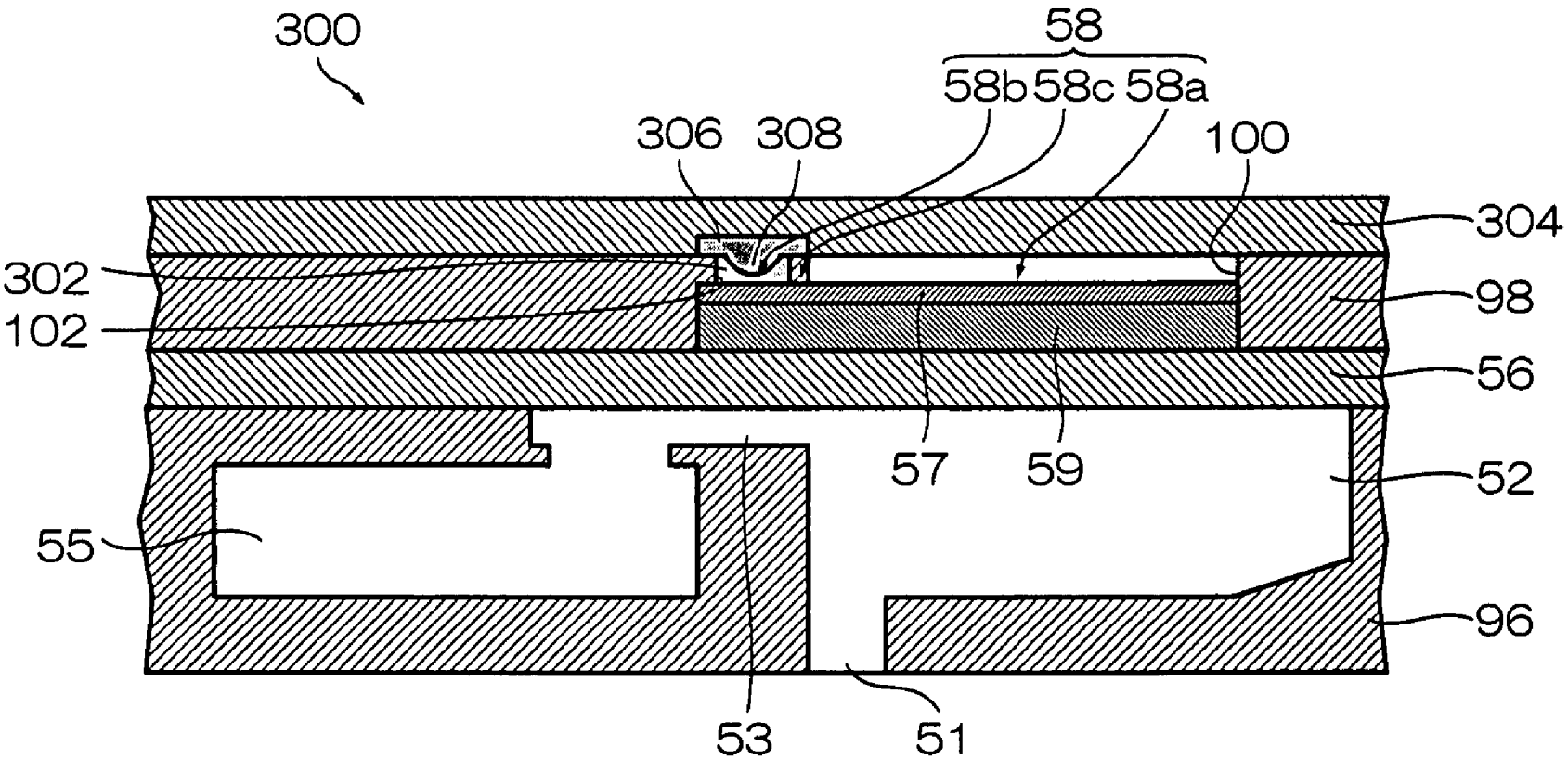
FIG. 15 is a cross-sectional diagram showing the composition of the principal part of a print head according to a third embodiment.

FIG. 15 is a cross-sectional diagram showing the composition of the principal part of the print head according to the third embodiment.

As shown in FIG. 15, the print head 300 according to the third embodiment has the common liquid chamber 55 formed below the piezoelectric elements 58.

The composition apart from the location of the piezoelectric elements 58 is the same as that of the print head 50 of the first embodiment, and therefore, the same reference numerals are assigned to constituent members which are the same as the print head 50 of the first embodiment, and further description thereof is omitted here.

As shown in FIG. 15, the nozzles 51, the pressure chambers 52, the ink supply ports 53 and the common liquid chamber 55 are formed in the flow channel plate 96 that is bonded to the lower surface of the diaphragm 56. The pressure chambers 52 and the common liquid chamber 55 are mutually connected by means of the ink supply ports 53, and the ink is supplied to the pressure chambers 52 from the common liquid chamber 55 through the ink supply ports 53.

The piezoelectric elements 58 are disposed on the diaphragm 56 at positions corresponding to the pressure chambers 52, and the resist layer 98 is formed so as to surround the piezoelectric elements 58. The resist over the movable portions 58*a* of the piezoelectric elements 58 and over the electrical connection portions 58*b* is removed from the resist layer 98, thereby forming the movement spaces 100 and the connection spaces 102. Conductive adhesive 302 is filled in the connection spaces 102.

A wiring plate 304 is bonded on top of the resist layer 98. The wiring plate 304 is constituted by a single plate, and wires 306 for applying drive voltages to the piezoelectric elements 58 are formed on the wiring plate 304. A bump 308 is formed at a position corresponding to the electrical connection portion 58*b* on each of the piezoelectric elements 58, and the bump 308 fits into the connection space 102, thereby electrically connecting the wire 306 with the conductive adhesive 302. By electrically connecting the wire 306 with the conductive adhesive 302, the wire 306 and the electrical connection portion 58*b* become electrically connected.

In the print head 300 according to the third embodiment having this composition, similarly to the print head 50 according to the first embodiment, the piezoelectric elements 58 are sealed in a state where the peripheral regions of the piezoelectric elements 58 are filled with the resist, and therefore, it is possible effectively to prevent leakage currents, as well as ensuring reliability in the electrical connections.

Furthermore, since the movable portion 58*a* and the electrical connection portion 58*b* of each piezoelectric element 58 are separated completely by means of the movement spaces 100 and the connection spaces 102 formed in the resist layer 98, it is easy to provide connection portions for the piezoelectric elements 58, and therefore the manufacturing process can be simplified.

Below, a method of manufacturing the print head 300 according to the third embodiment is described.

FIGS. 16A to 16E are illustrative diagrams of a manufacturing process for the print head 300 according to the third embodiment.

Figure 16A:
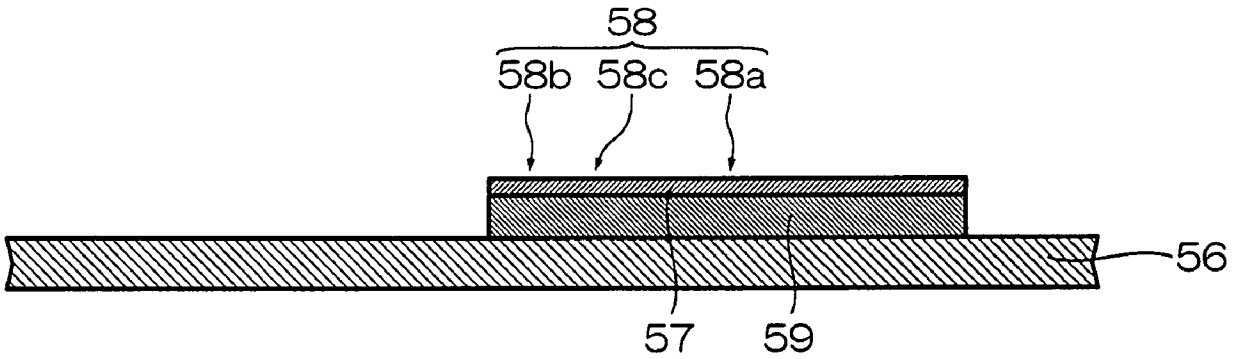
FIGS. 16A to 16E are illustrative diagrams of a manufacturing process for the print head according to the third embodiment.

Firstly, as shown in FIG. 16A, the piezoelectric elements 58 are disposed at prescribed positions on the diaphragm 56.

Figure 16B:
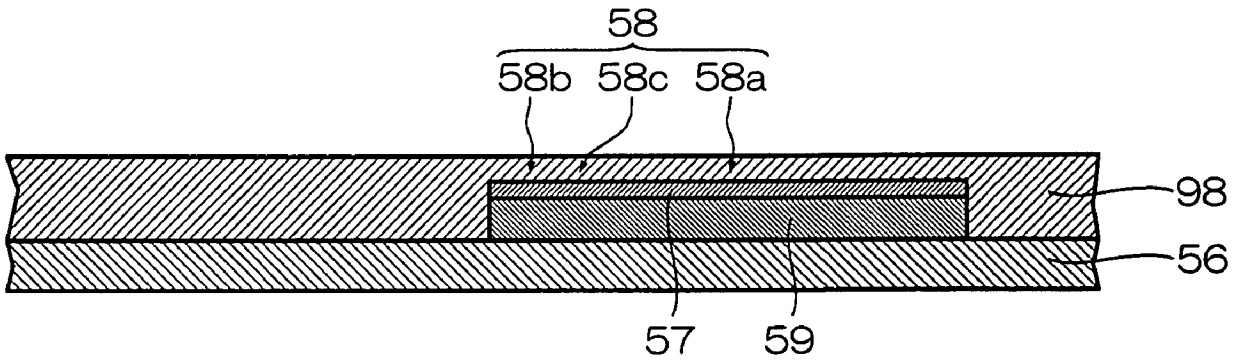

Thereupon, as shown in FIG. 16B, liquid resist is applied to the diaphragm 56 on which the piezoelectric elements 58 have been disposed. The applied resist is cured by baking, thereby forming the resist layer 98 on top of the diaphragm 56.

The applied resist is leveled to be slightly thicker than the piezoelectric elements 58, in such a manner that the piezoelectric elements 58 disposed on the diaphragm 56 are covered with the resist. There are no particular restrictions on the method of application used, and a method such as spin coating, spray coating, bar coating, or the like, may be used.

Figure 16C:
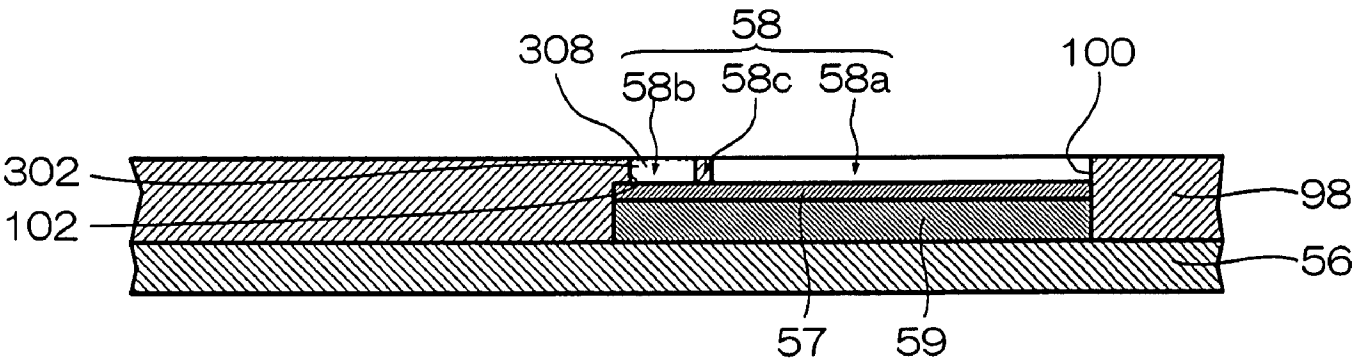

Thereupon, as shown in FIG. 16C, the resist covering over the movable portions 58*a* of the piezoelectric elements 58 and the electrical connection portions 58*b* is exposed, developed and removed, thereby forming the movement spaces 100 and the connection spaces 102 in the resist layer 98.

Figure 16D:
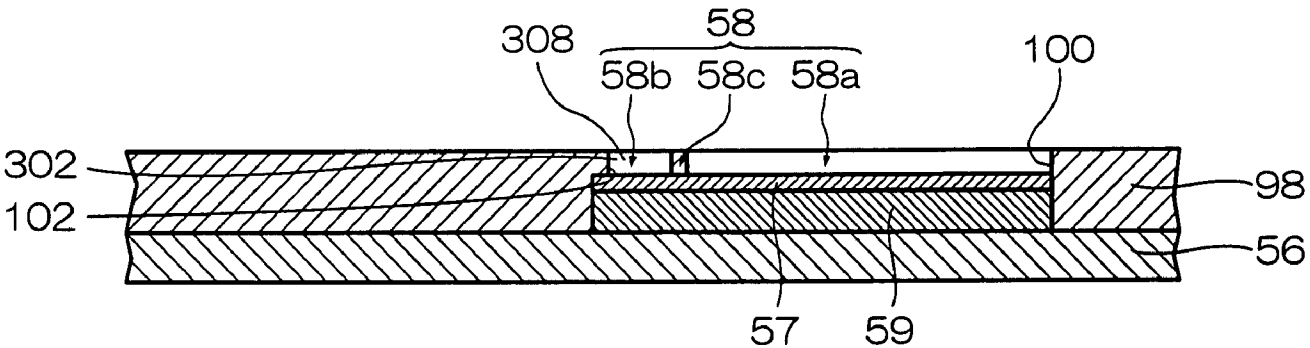

Next, as shown in FIG. 16D, the conductive adhesive 302 is filled into the connection spaces 102 formed in the resist layer 98.

There are no particular restrictions on the method of filling the conductive adhesive 302, and desirably, the conductive adhesive 302 is introduced by screen printing (including vacuum printing), similarly to the print head 50 according to the first embodiment. By this means, a large number of holes can be filled reliably, without exerting pressure on the piezoelectric elements 58.

Moreover, instead of the conductive adhesive 302, it is also possible to fill a conductive paste into the connection spaces 102.

Figure 16E:
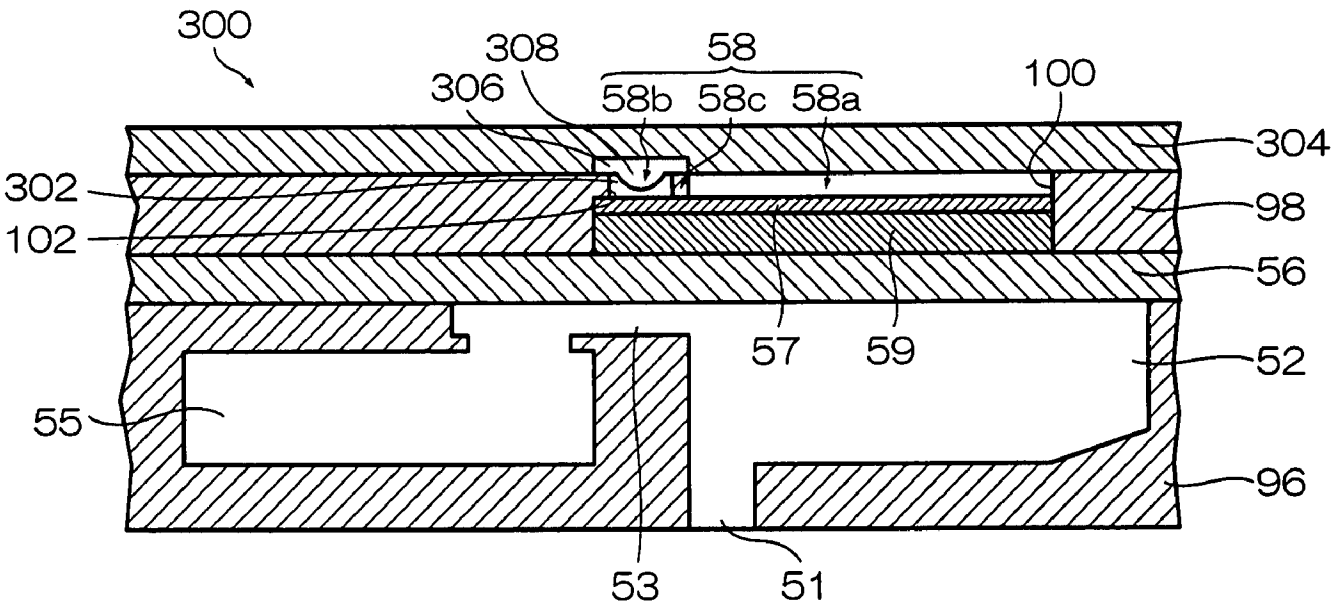

Next, as shown in FIG. 16E, the flow channel plate 96, which has been separately manufactured, is bonded onto the bottom of the diaphragm 56. There are no particular restrictions on the method of bonding the flow channel plate 96, and the flow channel plate 96 may be bonded onto the diaphragm 56 by using an adhesive, for example. Besides this, the flow channel plate 96 may also be bonded onto the diaphragm 56 by diffusion bonding, or the like.

The print head 300 according to the third embodiment is manufactured by means of the series of steps described above. In the thus manufactured print head 300, similarly to the print head 50 according to the first embodiment, since the electrical connection portion 58*b* and the movable portion 58*a* of each piezoelectric element 58 are sealed in a completely separated state, then it is possible to prevent leakage currents effectively, as well as ensuring reliability in the electrical connections. In this case, since the resist is a soft material, it has very little adverse effect on the displacement of the piezoelectric element 58, and therefore stable operation can be achieved.

Furthermore, since the conductive adhesive 302 is filled into the connection spaces 102 by screen printing, then it is possible to carry out a plurality of filling tasks reliably, without exerting undue force on the piezoelectric elements 58. Moreover, in this case, since the electrical connection portions 58*b* and the movable portions 58*a* are completely separated, it is easy to fill the conductive adhesive 302 into the connection spaces 102, and therefore the manufacturing process can be simplified.

Furthermore, the composition of the present embodiment resembles with that of the related art, and the reliability of the connections and the operation of the piezoelectric elements can be improved by means of small alterations in the process.

The series of embodiments are described with respect to a case where the liquid ejection head according to the present invention is used as a print head in an inkjet recording apparatus, but the application of the present invention is not limited to this, and it may also be applied to all types of liquid ejection heads which print text, images, or the like, on a recording medium.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A method of manufacturing a liquid ejection head comprising a pressure chamber which accommodates liquid, a diaphragm which forms a portion of the pressure chamber, a piezoelectric element which is disposed on the diaphragm and deforms the pressure chamber through the diaphragm to pressurize the liquid in the pressure chamber so as to eject the liquid from an ejection port in connection with the pressure chamber, the method comprising:

a resist layer forming step of applying a resist in a liquid state onto the diaphragm on which the piezoelectric element has been disposed so as to cover the piezoelectric element, and curing the resist to form the resist layer on the diaphragm;

a space forming step of separately removing the resist covering a movable portion of the piezoelectric element and the resist covering an electrical connection portion of the piezoelectric element, by exposing and developing the resist formed on the diaphragm, to separately form a movement space and a connection space for the piezoelectric element, in the resist layer; and a conductive material filling step of filling a conductive material into the connection space formed in the resist layer.

2. The method as defined in claim 1, wherein:

the conductive material is one of a conductive adhesive, a conductive paste and a conductive ink; and in the conductive material filling step, the conductive material is filled into the connection space by one of screen printing and vacuum printing.

3. The method as defined in claim 1, further comprising:

a substrate bonding step of bonding, onto the resist layer, a substrate having a through hole at a position corresponding to the connection portion of the piezoelectric element, after the space forming step, wherein, in the conductive material filling step, the conductive material is filled into the through hole in the substrate and the connection space in the resist layer.

4. The method as defined in claim 3, wherein:

the conductive material is one of a conductive adhesive, a conductive paste and a conductive ink; and in the conductive material filling step, the conductive material is filled into the through hole and the connection space by one of screen printing and vacuum printing.

* * * * *